US011713700B2

(12) United States Patent
McCord

(10) Patent No.: US 11,713,700 B2
(45) Date of Patent: Aug. 1, 2023

(54) METHOD AND APPARATUS FOR CONVERTING A VEHICLE FROM A DUAL-IN, SINGLE-OUT EXHAUST SYSTEM TO A DUAL-IN, DUAL-OUT EXHAUST SYSTEM

(71) Applicant: Mike's Pipes, Inc., Molt, MT (US)

(72) Inventor: Michael Todd McCord, Molt, MT (US)

( * ) Notice: Subject to any disclaimer, the term of this patent is extended or adjusted under 35 U.S.C. 154(b) by 461 days.

(21) Appl. No.: 16/938,265

(22) Filed: Jul. 24, 2020

(65) Prior Publication Data

US 2022/0025793 A1 Jan. 27, 2022

(51) Int. Cl.

| | |
|---|---|
| ***F01N 13/08*** | (2010.01) |
| ***F01N 1/02*** | (2006.01) |
| ***F01N 13/18*** | (2010.01) |
| ***G10K 11/16*** | (2006.01) |

(52) U.S. Cl.

CPC ..... *F01N 1/02* (2013.01); *F01N 13/1805* (2013.01); *F01N 13/1838* (2013.01); *G10K 11/161* (2013.01); *F01N 2470/14* (2013.01); *F01N 2470/16* (2013.01)

(58) Field of Classification Search

CPC . F01N 1/02; F01N 13/04; F01N 13/08; F01N 13/10; F01N 13/18; F01N 13/1805; F01N 13/1822; F01N 13/1838; F01N 2470/14; F01N 2470/16; G10K 11/161

See application file for complete search history.

(56) References Cited

U.S. PATENT DOCUMENTS

| | | | | |
|---|---|---|---|---|
| 1,613,580 A | | 1/1927 | Neal | |
| 2,996,139 A | * | 8/1961 | Patterson | F01N 1/08 181/239 |
| 4,537,278 A | | 8/1985 | Okada | |
| 4,819,428 A | * | 4/1989 | Ciccarone | F01N 13/04 181/240 |
| 4,926,634 A | | 5/1990 | Putz | |
| 5,214,253 A | * | 5/1993 | Houston, Jr. | F01N 13/08 181/239 |
| 5,351,481 A | * | 10/1994 | Flugger | F02B 27/04 181/240 |
| 5,388,408 A | | 2/1995 | Lawrence | |
| 5,740,671 A | * | 4/1998 | Jones | F01N 1/02 60/323 |
| 5,802,845 A | | 9/1998 | Abe | |

(Continued)

FOREIGN PATENT DOCUMENTS

| | | | | |
|---|---|---|---|---|
| EP | 2314834 A1 | * | 4/2011 | F01N 1/02 |
| KR | 100812227 B1 | * | 3/2008 | |

*Primary Examiner* — Edgardo San Martin

(74) *Attorney, Agent, or Firm* — Antoinette M. Tease

(57) ABSTRACT

An exhaust pulse balance chamber comprising a circular collar, mid-section that bulges at its center, skirt, and right and left legs, all of which are sealed to the exterior environment and in fluid communication with one another. The outer diameter of the skirt increases in width but not in depth from the proximal end of the skirt to the distal end of the skirt, which is configured to receive the right and left legs. Each leg is bent at a 30-degree angle relative to the central longitudinal axis of the exhaust pulse balance chamber. The invention includes a method of using the exhaust pulse balance chamber to convert a vehicle from a dual-in, single-out exhaust system to a dual-in, dual-out exhaust system.

10 Claims, 14 Drawing Sheets

(56) References Cited

U.S. PATENT DOCUMENTS 6,141,958 A * 11/2000 Voss ..... F01N 13/009 181/254
6,382,348 B1 5/2002 Chen
6,584,767 B1 7/2003 Koenig
6,637,537 B2 10/2003 Porter
6,662,554 B2 12/2003 Sheidler
6,708,798 B2 3/2004 Chang
6,840,037 B2 * 1/2005 Oberhardt ..... F01N 13/08 60/322
7,040,451 B2 5/2006 Schumacher
7,458,210 B2 * 12/2008 Kikuchi ..... F01N 13/08 60/323
7,849,959 B2 12/2010 Amir
8,042,649 B2 * 10/2011 Inoue ..... F01N 1/003 181/227
8,181,732 B1 * 5/2012 Butler ..... F01N 13/08 181/239
8,196,703 B2 * 6/2012 Stanley ..... F01N 13/08 181/232
8,434,588 B2 5/2013 Matsueda
D696,614 S 12/2013 Lee
9,528,425 B2 * 12/2016 Lee ..... F01N 13/1805
9,706,295 B2 7/2017 Pommerer
9,752,475 B2 9/2017 Peters
D810,644 S 2/2018 Welter
9,945,276 B2 4/2018 Drees
10,145,287 B2 12/2018 Garnemark
10,584,626 B2 3/2020 Herwat
10,641,156 B2 * 5/2020 Koda ..... F01N 1/00
10,900,396 B2 * 1/2021 Ayesh ..... F01N 1/006
11,248,511 B2 * 2/2022 Hugh ..... F01N 13/107
2002/0113173 A1 * 8/2002 Bass ..... B60K 13/04 248/62
2002/0175022 A1 11/2002 Schumacher
2003/0121720 A1 7/2003 Chang
2010/0071990 A1 3/2010 Amir
2010/0192558 A1 8/2010 Matsueda
2010/0237607 A1 * 9/2010 Crone ..... F01N 13/082 138/155
2014/0376733 A1 12/2014 Pommerer
2017/0058733 A1 3/2017 Peters
2017/0198617 A1 7/2017 Drees
2017/0335738 A1 11/2017 Garnemark
2019/0338690 A1 11/2019 Herwat
2022/0025793 A1 * 1/2022 McCord ..... F01N 13/1805
2022/0356823 A1 * 11/2022 Fabiani ..... F01N 1/166

* cited by examiner

FIGURE 21
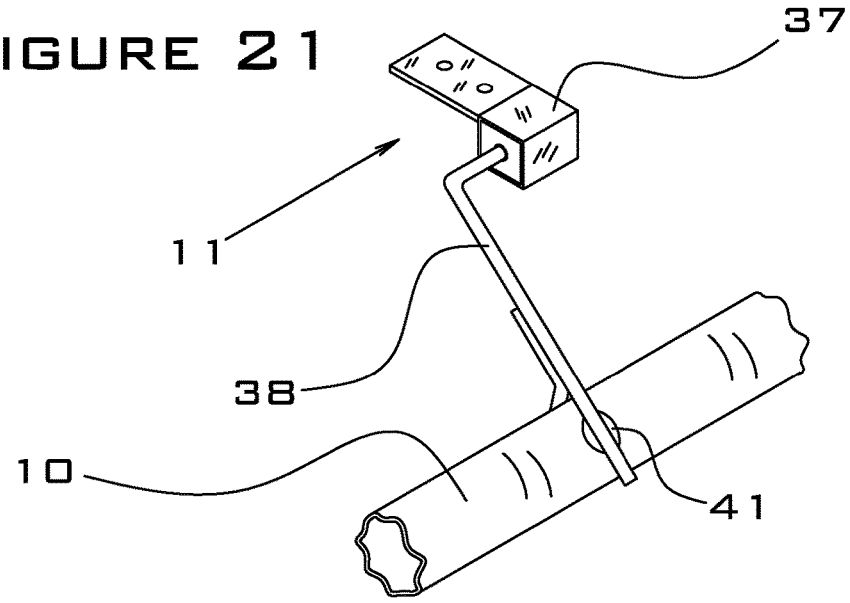
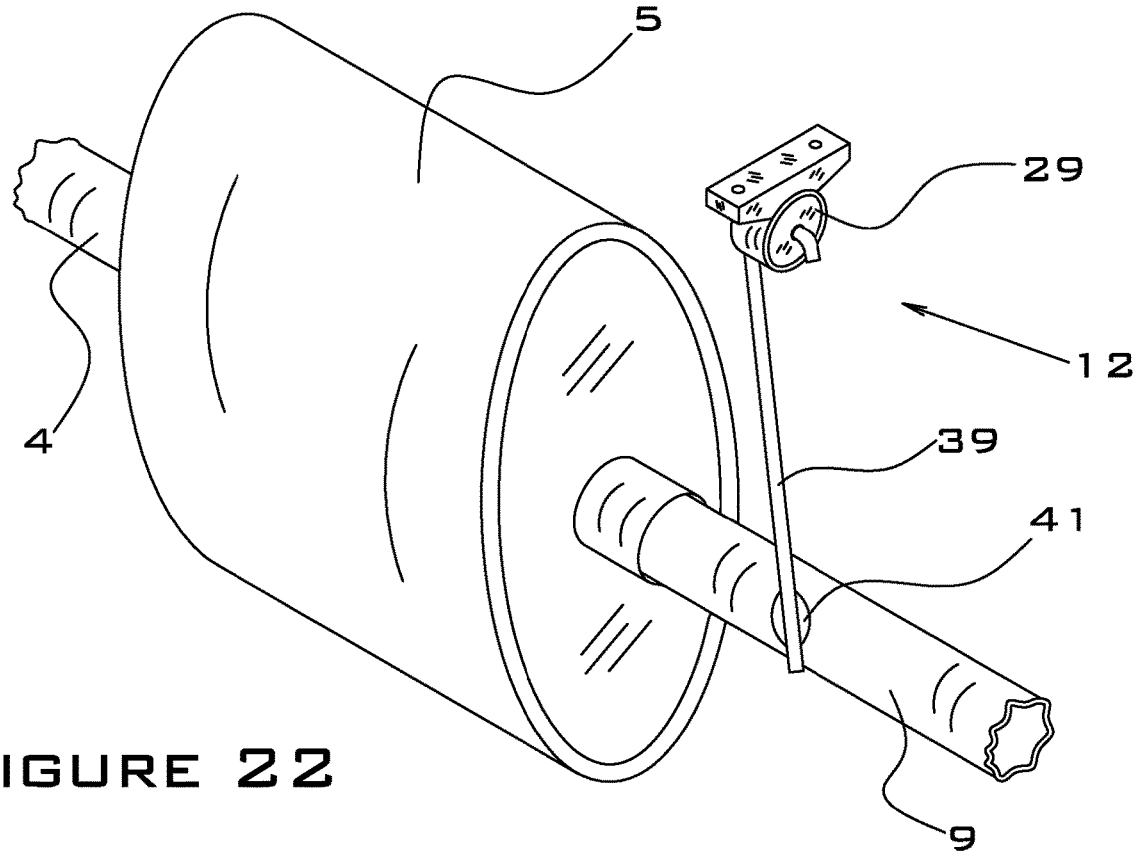
FIGURE 22

METHOD AND APPARATUS FOR CONVERTING A VEHICLE FROM A DUAL-IN, SINGLE-OUT EXHAUST SYSTEM TO A DUAL-IN, DUAL-OUT EXHAUST SYSTEM

BACKGROUND OF THE INVENTION

1. Field of the Invention

The present invention relates generally to the field of automotive improvements, and more particularly, to a method and apparatus for converting a gasoline-powered pickup truck or sport utility vehicle with a V8- or V6-style engine from a dual-in, single-out exhaust system to a dual-in, dual-out (i.e., true dual-exhaust) system.

2. Description of the Related Art

The current design of the exhaust systems of gasoline-powered pickup trucks and sport utility vehicles with a V8- or V6-style engine begins with flanges that are bolted to the engine exhaust manifolds. Each exhaust manifold is mounted to the cylinder head and extends downward and consists of one solid piece that includes a mounting flange to which the exhaust system connects. There is one exhaust manifold on each side of the engine (right and left). The exhaust piping mounts to the manifold via the flanges and continues rearward in the vehicle. This piping extends until it reaches a pair of catalytic converters. Since 1996, because of environmental restrictions on emissions, there has been a minimum of two catalytic converters—one on each side of the vehicle.

After the catalytic converters, each side of the exhaust continues until the two sides converge at a "Y" pipe. This Y-pipe joins each separate side of the exhaust system together into a single metal pipe for the exhaust gases to flow. In stock exhaust systems, the Y-pipe is located along the passenger's side of the vehicle inside of the frame rail of the chassis beneath the cab. The right side exhaust, from the manifold to the Y-pipe, runs from the manifold straight down on the inside of the frame rail until it reaches the Y-pipe. The left side exhaust comes from the driver's side manifold and travels laterally across the vehicle, usually under the transmission, to the passenger's side to reach the Y-pipe. This difference in the piping creates a length difference that results in the right side of the exhaust being much shorter than the left-side exhaust.

After the Y-pipe, the exhaust gases continue in a single pipe under the cab until that pipe reaches either one or multiple mufflers and/or resonators of a single inlet and single outlet design (that is, with only one pipe going into the muffler and only one pipe coming out of the muffler). Once the exhaust has exited the muffler, the exhaust piping continues over the rear axle until it stops at the back of the vehicle, where the exhaust gases are finally ventilated.

The problem with the stock exhaust systems described above is that they are highly restrictive. When the exhaust travels from two separate exhaust pipes to a single pipe, the pressure increases. This increase of pressure restricts the ease with which the engine can remove the exhaust gases. Greater restriction means more internal power losses due to the fact that power is used to forcefully remove exhaust gases rather than to create additional horsepower. Having physical restrictions within the exhaust system can also limit the extent to which the engine can draw fresh fuel-air mixture into the combustion chamber. This restrictive design also limits the maximum horsepower and torque of an engine, at the same time reducing gas mileage.

The present invention solves these problems by replacing the factory Y-pipe with an exhaust pulse balance chamber. This exhaust pulse balance chamber combines both pipes into a single-diameter pipe and then splits again (after the heart of the exhaust pulse balance chamber) into two separate pipes. The exhaust is then run via two pipes into two single in/single/out high-flow mufflers. Two exhaust pipes are run over the rear axle to the back of the vehicle. The present invention increases performance and fuel economy with a tunable and desirable sound.

U.S. Pat. No. 1,613,580 (Neal, 1924) discloses a hot water heating device for automobiles in which water is heated in a water jacket or drum arranged in an auxiliary muffler connected with the exhaust pipe of the engine and directed therefrom through the radiators. A valve controls the passage in the exhaust pipe between the auxiliary muffler and the main muffler, thereby directing the heated exhaust gases through either of the mufflers, so that the heater may be used only when necessary.

U.S. Pat. No. 4,537,278 (Okada et al., 1985) provides an exhaust duct connector in the form of a Y-shaped passage. Both of the branches of the Y are adapted to receive ends of upstream exhaust ducts, and a leg of the Y is adapted to receive one end of a downstream exhaust duct. A substantially plate-like partition is positioned at the junction of the Y parallel to the single leg. The partition includes a plurality of holes through which exhaust can pass.

U.S. Pat. No. 4,926,634 (Putz et al., 1990) discloses a method and apparatus for producing a homogeneous exhaust gas mixture in an exhaust system for an internal combustion engine having two banks of cylinders. In this invention, equal portions of the exhaust stream from first and second cylinder banks are combined and then fed to two catalysts. A lambda probe to control the fuel-air ratio is disposed in the path leading to one of the catalysts.

U.S. Pat. No. 5,388,408 (Lawrence, 1995) provides an exhaust system for internal combustion engines comprised of a sound attenuating chamber having a single, common opening in an imperforate container, the opening providing access for exhaust gases both to and from the container while attenuating the exhaust sound thereof. Resonator tubes and sound absorbing material are optionally used in the chamber to control exhaust sounds.

U.S. Pat. No. 5,802,845 (Abe et al., 1998) discloses an exhaust gas purification system for an internal combustion engine. The system comprises an exhaust system having an adsorption flow path provided with an adsorbent capable of adsorbing harmful components such as hydrocarbons in an exhaust gas, and a catalyst flow path provided with at least one catalyst for decreasing the harmful components in the exhaust gas. An outlet of the adsorption flow path is joined to the catalyst flow path at a predetermined position on the upstream side of the catalyst to form a joint portion. The exhaust gas produced at least at the time of the operation start of the internal combustion engine is divided so as to flow through both the adsorption flow path and the catalyst flow path in a predetermined ratio, so that part of the harmful components such as the hydrocarbons are adsorbed by the adsorbent in the adsorption flow path. When the adsorbed harmful components begin to desorb from the adsorbent with the temperature rise of the adsorbent, the catalyst on the downstream of the joint portion is activated.

U.S. Pat. No. 6,382,348 (Chen, 2002) provides a twin muffler comprised of two muffling units connected in parallel to the exhaust post of an engine through a manifold.

Each muffling unit has a front accumulation chamber, a rear accumulation chamber, a perforated inner tube connected between the front and rear accumulation chambers, an internally tapered guide tube adapted to guide exhaust air from the perforated inner tube to the rear accumulation chamber, and a hopper-like exhaust endpiece adapted to guide exhaust gas out of the rear accumulation chamber. The perforated inner tube has a twisted middle section for causing exhaust gas to form a spiral flow.

U.S. Pat. No. 6,584,767 (Koenig, 2003) discloses an exhaust diverter for selectively attenuating exhaust volume. The exhaust diverter is comprised of a first pipe for fluidly coupling to and positioning between the engine and the muffler and a second pipe, the first end of which is fluidly coupled to the first pipe, and the second end of which is fluidly coupled to an exhaust pipe. A valve system, which is controlled by an actuator, electively opens and closes passages through the first and second pipes.

U.S. Pat. No. 6,637,537 (Porter el al., 2003) provides a dual stack exhaust system for a pickup truck. A flexible exhaust coupler is in fluid communication with the outlet end of the exhaust pipe, and a hollow elongated collector is disposed on the floor of the truck bed adjacent the front wall. An inlet is disposed within the midportion of the collector and connected to the coupler through an opening in the bed. First and second outlets in the collector are in fluid communication with the inlet. First and second tubular exhaust stacks are connected to the first and second outlets and extend vertically upwardly therefrom to open upper ends.

U.S. Pat. No. 6,708,798 (Chang, 2004) describes an exhaust pipe with a manifold. One end of the manifold is connected to a distal end of a connecting tube. The other end of the manifold forms first and second branch tubes, each of which is connected to an outer tube. The second branch tube has a controllable valve. Glass fibers and a layer of stainless steel and cotton are contained within each outer tube. A connecting piece is welded between the first and second outer tubes.

U.S. Pat. No. 6,662,554 (Sheidler et al., 2003) provides an adjustable restriction muffler system for a combine in which a bypass flow path in an exhaust pipe is located upstream of a primary muffler. A diaphragm may be used to manipulate a damper, which acts to close the exhaust flow to the primary muffler and open the bypass to an exhaust pipe to effectively bypass the primary muffler.

U.S. Pat. No. 7,040,451 (Schumacher et al., 2006) discloses an automotive exhaust silencer system with variable damping characteristics. The invention comprises a plurality of mufflers and an actuator for changing the flow resistance to the exhaust gases flowing through the mufflers. The actuator is situated in a pipe branch having an inlet and two outlets, and each outlet is connected via a pipe to a muffler. The throughflow cross section of the inlet is variable by means of the actuator.

U.S. Pat. No. 7,849,959 (Amir et al., 2010) describes an exhaust pipe structure for a vehicle in which an exhaust pipe extends from the engine in the front part of the vehicle to a branch part in the rear of the vehicle. Right and left branch pipes extend from the branch part to mufflers on the right and left sides of the vehicle. The branch part is arranged so as to be offset to the side of either the right or left muffler. The exhaust pipe has an upstream part that is laid linearly to a bend part positioned in the center of the vehicle width direction near the rear end of a fuel tank and an oblique part laid slantwise from the bend part toward the branch part.

U.S. Pat. No. 8,434,588 (Matsueda, 2013) provides an exhaust system for an internal combustion vehicle in which an exhaust pipe branches at a branching point into a downstream-side first branch pipe and a downstream-side second branch pipe. First and second silencers are attached to the first and second branch pipes. The first and second branch pipes are different in at least one of bending rigidity and mass so that when the first and second branch pipes are vibrated in a specific vibration frequency range, vibrations of the two branch pipes cancel out each other at the branching point.

U.S. Pat. No. 9,706,295 (Pommerer et al., 2017) discloses an anti-noise system for influencing exhaust noises propagating through a multi-flow exhaust system. The invention comprises a controller and at least one actuator that is disposed in a sound generator. The sound generator is connectable simultaneously to at least two exhaust tracts of the multi-flow exhaust system. The controller is configured to generate a control signal that prompts the at least one actuator to cancel sound inside the at least two exhaust tracts.

U.S. Pat. No. 9,752,475 (Peters et al., 2017) provides an exhaust system for an internal combustion engine, the invention comprising a muffler, a first exhaust pipe that is connected to the muffler for sound dampening, and a second exhaust pipe that extends in terms of flow in parallel relation to the first exhaust pipe and extends through the first muffler without a flow communication therewith. The first and second exhaust pipes originate from a common exhaust pipe. A switching valve adjusts a throughflow cross section of the second exhaust pipe.

U.S. Pat. No. 9,945,276 (Drees et al., 2018) discloses an exhaust system for an internal combustion engine with first and second cylinders, in which the first cylinder is assigned a first exhaust gas pipe, and the second cylinder is assigned a second exhaust gas pipe. The first exhaust gas pipe is assigned a first muffler, and the second exhaust gas pipe is assigned as second muffler. A first damping pipe branches off from the first exhaust gas pipe upstream of a first shut-off element. The damping pipe opens into a first reflection chamber and is then led through the first muffler and opens into the second exhaust gas manifold downstream of a second shut-off element. A second damping pipe branches off from the second exhaust gas pipe upstream of a second shut-off element. The damping pipe opens into a second reflection chamber and is then led through the second muffler and opens into the first exhaust gas manifold downstream of a first shut-off element.

U.S. Pat. No. 10,145,287 (Garnemark, 2018) provides a dual catalytic converter exhaust-gas after-treatment arrangement for an internal combustion engine comprising a first catalytic converter, a second catalytic converter arranged in parallel with the first catalytic converter, the first and second catalytic converters being arranged to receive exhaust gas from an engine, a connection pipe fluidly connecting an outlet of the second catalytic converter with an inlet of the first catalytic converter, and an outlet valve arranged in the outlet of the second catalytic converter downstream of the connection pipe. The outlet valve is configured to control a flow of exhaust gas through the second catalytic converter.

U.S. Pat. No. 10,584,626 (Herwat et al., 2020) discloses a muffler assembly comprised of a center muffler and two satellite mufflers. The first muffler includes a first housing and an X-shaped pipe that is at least partially disposed within the first housing. The X-pipe has first and second inlets and first and second outlets that are all fluidly connected to one another. The first and second inlets receive exhaust gas from the engine. The second muffler includes a second housing and a first Y-pipe that is at least partially disposed therein. The first Y-pipe has a third inlet that receives exhaust gas from the first outlet, and third and fourth outlets. The third muffler includes a third housing and a second Y-pipe that is at least partially disposed therein. The second Y-pipe h as a fourth inlet that receives exhaust gas from the second outlet, and fifth and sixth outlets.

U.S. Pat. No. D696614 (Lee el al., 2013) depicts a design for a branch pipe of a dual muffler for a vehicle. U.S. Pat. No. D810644 (Welter, 2018) illustrate an exhaust system.

BRIEF SUMMARY OF THE INVENTION

The present invention is an exhaust pulse balance chamber comprising: a proximal end and a distal end; a circular collar at the proximal end of the exhaust pulse balance chamber; a mid-section; a skirt; and a right leg and a left leg; wherein the circular collar is configured to connect to an outlet end of a factory Y-pipe; wherein the mid-section has an inner diameter; wherein the circular collar has a constant inner diameter that is smaller than the inner diameter of the mid-section at a central lateral axis of the mid-section; wherein the mid-section is configured to form a bulge between the circular collar and the skirt; wherein the mid-section has an outer diameter; wherein the outer diameter of the mid-section increases from the proximal end of the mid-section to the central lateral axis of the mid-section and decreases from the central lateral axis of the mid-section to the distal end of the mid-section; wherein the distal end of the mid-section is joined to a proximal end of the skirt; wherein the skirt has an outer diameter; wherein the outer diameter of the skirt increases in a left-to-right direction without increasing in a front-to-back direction from the proximal end of the skirt to a distal end of the skirt; wherein the distal end of the skirt is configured to receive the right and left legs; wherein each of the right and left legs has a proximal end; wherein the proximal end of each of the right and left legs extends from the distal end of the skirt at a first 30-degree angle relative to a central longitudinal axis of the exhaust pulse balance chamber for a first distance; wherein each of the right and left legs bends at a second 30-degree angle after the first distance and then extends for a second distance; wherein the right and left legs are parallel to each other for the second distance; wherein the exhaust pulse balance chamber is sealed to an exterior environment except at the proximal end of the circular collar and the distal ends of the right and left legs; and wherein the circular collar, mid-section, skirt and right and left legs are all within fluid communications with one another.

In a preferred embodiment, the mid-section and the skirt are formed form a single piece of metal that is welded to the circular collar and to the right and left legs. Preferably, the outer diameter of the mid-section at the distal end of the mid-section equals the inner diameter of the mid-section at the proximal end of the mid-section. The skirt preferably extends over and around the proximal ends of the right and left legs.

In a preferred embodiment, the circular collar has an outer diameter that is constant; and the outer diameter of the skirt measured front-to-back is less than the outer diameter of the circular collar. Preferably, the outer diameter of the skirt measured right-to-left at a distal end of the skirt is approximately two times the outer diameter of the skirt measured front-to-back at a distal end of the skirt. The first distance is preferably approximately equal to one-third of the second distance. In another preferred embodiment, each of the right and left legs has a length; and the length of each of the right and left legs is approximately three times a length of the circular collar, the mid-section and the skirt combined.

The present invention is also a method of converting a vehicle from a dual-in, single-out exhaust system to a dual-in, dual-out exhaust system, the vehicle comprising a factory muffler assembly and a chassis, the method comprising the steps of: cutting a factory tailpipe behind an outlet end of a factory muffler; removing the factory tailpipe; cutting a factory Y-pipe above an outlet end of the factory Y-pipe; removing the factory muffler assembly from the vehicle; installing the exhaust pulse balance chamber described above onto the cutoff outlet end of the factory Y-pipe; rotating the exhaust pulse balance chamber so that the right and left legs of the exhaust pulse balance chamber are parallel with the vehicle chassis; connecting an inlet end of a right intermediate pipe to the distal end of the right leg of the exhaust pulse balance chamber; installing an inlet end of a right replacement muffler onto an outlet end of the right intermediate pipe; connecting an inlet end of a left intermediate pipe to the distal end of the left leg of the exhaust pulse balance chamber; installing an inlet end of a left replacement muffler onto an outlet end of the left intermediate pipe; welding together the right and left replacement mufflers; installing an inlet end of a right tailpipe onto an outlet end of the right replacement muffler; installing an inlet end of an axle pipe onto an outlet end of the left replacement muffler; installing an inlet end of a left tailpipe onto an outlet end of the axle pipe; and laying down continuous gas-tight welds around all pipe connections.

The present invention is also a kit for converting a vehicle from a dual-in, single-out exhaust system to a dual-in, dual-out exhaust system, the kit comprising: the exhaust pulse balance chamber described above; a right intermediate pipe; a right replacement muffler; a left intermediate pipe; a left replacement muffler; a right tailpipe; an axle pipe; and a left tailpipe.

BRIEF DESCRIPTION OF THE DRAWINGS

FIG. 21 is a perspective view of the third hanger showing the attachment of the hanger to the sides of the left tailpipe.

FIG. 22 is a perspective view of the fourth hanger showing the attachment of the hanger to the left side of the axle pipe.

REFERENCE NUMBERS

Figure 1:
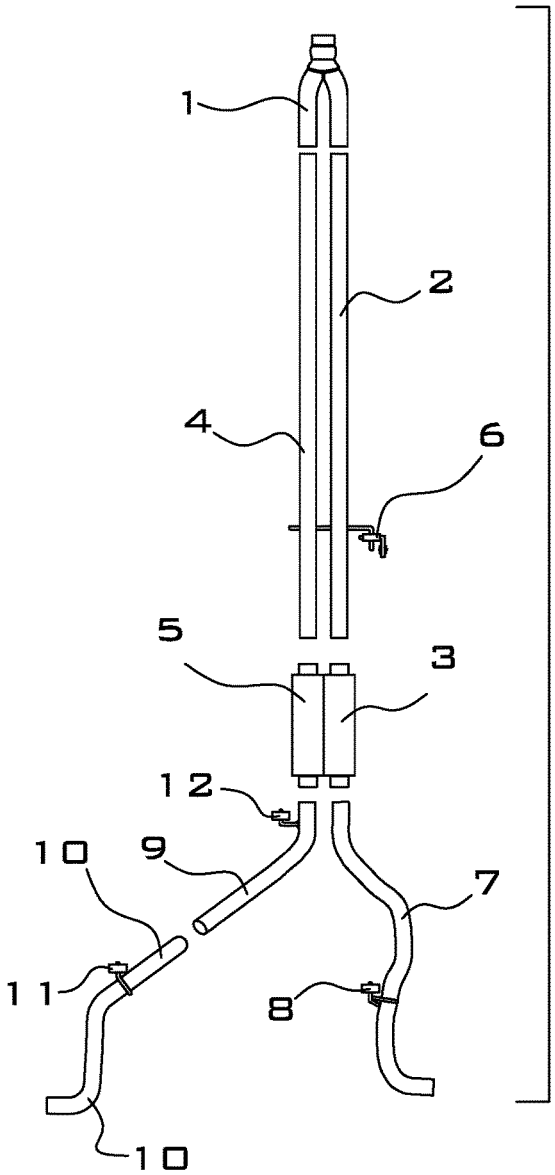
FIG. 1 is a plan view of the major components of the present invention shown prior to assembly and installation.

1 Exhaust pulse balance chamber
2 Right intermediate pipe
3 Right replacement muffler
4 Left intermediate pipe
5 Left replacement muffler
6 First hanger
7 Right tailpipe
8 Second hanger
9 Axle pipe
10 Left tailpipe
11 Third hanger
12 Fourth hanger
13 Right catalytic converter
14 Two-bolt flange
15 Left catalytic converter
17 Factory Y-pipe
18 First factory intermediate pipe
19 Resonator
20 Second factory intermediate pipe
21 Factory muffler
22 Fifth hanger
23 Sixth hanger
24 Factory tailpipe
25 Seventh hanger
26 Support rod of seventh hanger
27 Isolator of seventh hanger
28 Support rod of sixth hanger
29 Isolator of sixth hanger
30 Factory muffler assembly
31 Rear axle assembly
32 Isolator of first hanger
33 Support rod of first hanger
34 Support rods of second hanger
35 Zip tie
36 Wire bundle
37 Isolator of third hanger
38 Support rods of third hanger
39 Support rod of fourth hanger
40 Decorative exhaust tip
41 Spot weld
42 Proximal end (of exhaust pulse balance chamber)
43 Distal end (of exhaust pulse balance chamber)
44 Circular collar (of exhaust pulse balance chamber)
45 Mid-section (of exhaust pulse balance chamber)
46 Skirt (of exhaust pulse balance chamber)
47 Legs (of exhaust pulse balance chamber)

DETAILED DESCRIPTION OF INVENTION

A. Overview

By virtue of its unique design, the present invention increases the flow of exhaust gases from the manifolds, thereby decreasing the back pressure. Generally speaking, a decrease in back pressure increases performance and fuel economy but poses an additional problem. With less back pressure, there exists a cab resonance or a drone sound in the cab created by the unbalanced exhaust pulses. The unbalanced exhaust pulses are created because of the fact that the head pipes are unequal in length. This undesired droning noise is heard at an engine rpm in the range of 1300 to 1700 rpm, which equates to about 35 mph at 1300 rpm and about 70 mph at 1700 rpm.

The present invention specifically addresses these concerns by installing an exhaust pulse balance chamber at the outlet end of the factory Y-pipe. The exhaust pulse balance chamber combines the sound waves from both manifolds before splitting the exhaust back up into two pipes. The difference in exhaust pulses from the right manifold and the left manifold is caused by the different in length of each side of the exhaust. The exhaust pulses hit between 18 to 20 inches in the factory Y-pipe, and the length difference is enough to be heard in exhaust systems without an exhaust pulse balance chamber. The exhaust pulse balance chamber reduces both sides of the exhaust into a single-diameter pipe in which the pressure of both waves along the wavelength and phase become normalized into a single outputted sound wave. This effect minimizes the droning sound by reducing the two separate sound waves into one.

The present invention significantly decreases back pressure by providing two exhaust pathways rather than one, thereby increasing performance and fuel economy. With the addition of the exhaust pulse balance chamber, the resonance droning sounds are minimized, creating a desirable sounding exhaust system.

By contrast, the factory exhaust system uses a restrictive muffler to stack the exhaust pulse and specifically build the back pressure in order to keep the in-cab droning sounds to a minimum. This noise reduction, however, is accomplished at the expense of horsepower and fuel economy. The OEM manufacturers have not addressed this problem due to cost considerations. Other independent exhaust shops have tried to address this problem by putting in true dual exhaust without the exhaust pulse balance chamber, but the undesirable droning noises within the cab persist. Other independent exhaust shops have tried to address the resonance droning sounds with either an H pipe or an X pipe, but these pipes do not reduce both sides of the exhaust to a single-diameter balancing chamber. Consequently, they do not adequately address the problem of in-cab drone.

B. Detailed Description of the Figures

FIG. 1 is a plan view of the major components of the present invention shown prior to assembly and installation. As shown in this figure, the present invention comprises an exhaust pulse balance chamber 1, a right intermediate pipe 2, a right replacement muffler 3, a left intermediate pipe 4, a left replacement muffler 5, a right tailpipe 7, an axle pipe 9, and a left tailpipe 10. The present invention further comprises first, second, third and fourth hangers 6, 8, 11, 12. These parts make up the system of the present invention.

Figure 2:
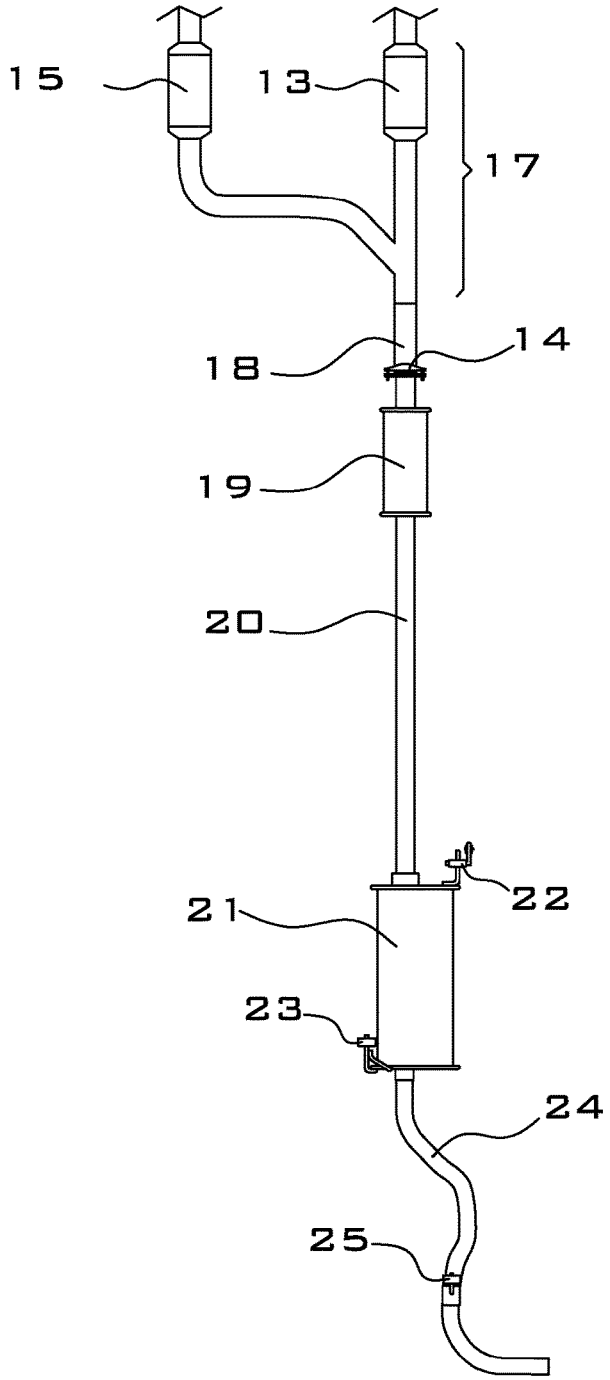
FIGURE 2 PRIOR ART
FIG. 2 is a plan view of an example of a prior art exhaust system prior to installation of the present invention.

FIG. 2 is a plan view of an example of a prior art exhaust system prior to installation of the present invention. This figure shows the right catalytic converter 13, and the left catalytic converter 15, both of which are situated (in this example) on the factory Y-pipe 17. This figure also shows the first factory intermediate pipe 18, which is connected to the resonator 19 with a two-bolt flange 14, and the second factory intermediate pipe 20, which is connected to the factory muffler 21. This figure also shows the factory tailpipe 24 and the fifth, sixth and seventh hangers 22, 23, 25.

Figure 3:
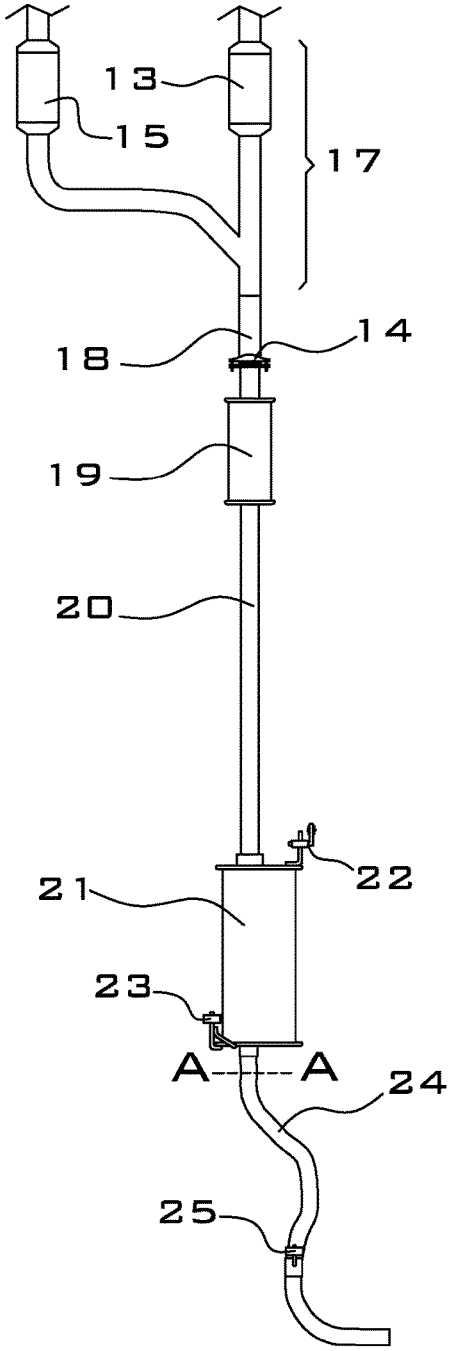
FIGURE 3 PRIOR ART
FIG. 3 is a plan view of the prior art showing the location of the first cut that illustrates the first step of the method.

FIG. 3 is a plan view of the prior art showing the location of the first cut that illustrates the first step of the method. In the first step of the method of the present invention, the factory tailpipe 24 is cut about six inches behind the outlet end of the factory muffler 21. This cut is shown as dotted line A-A in FIG. 3.

Figure 4:
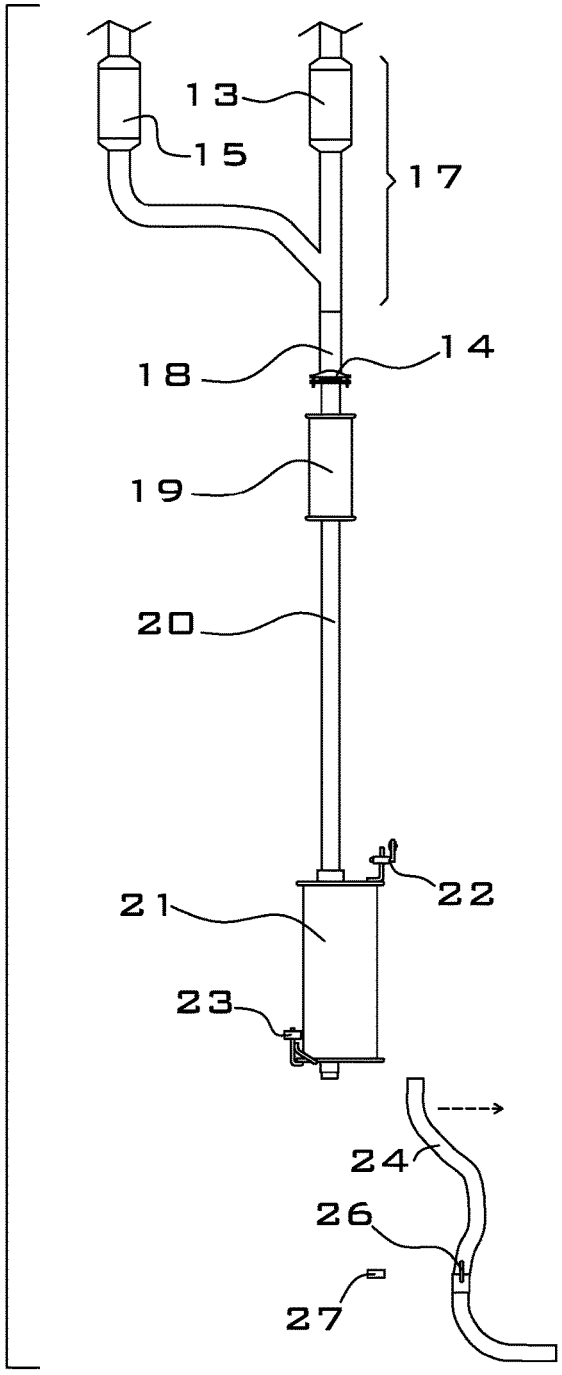
FIGURE 4 PRIOR ART
FIG. 4 is a plan view of the prior art showing the removal of the tailpipe that illustrates second step of the method.

FIG. 4 is a plan view of the prior art showing the removal of the tailpipe that illustrates second step of the method. In the second step of the method of the present invention, the support rod 26 of the seventh hanger 25 is slid out of the isolator 27 of the seventh hanger 25, and the factory tailpipe 24 is removed. The isolator 27 is left in place, where it is attached to the vehicle chassis (not shown). The support rod 26 is left attached to the factory tailpipe 24 for disposal.

Figure 5:
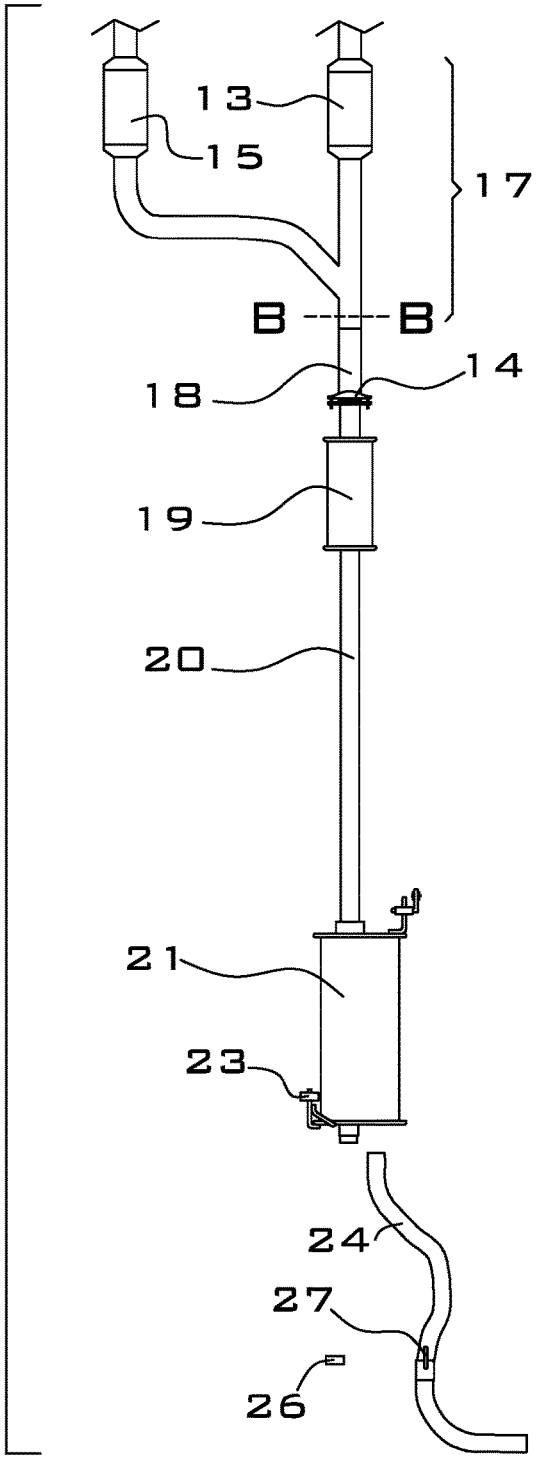
FIGURE 5 PRIOR ART
FIG. 5 is a plan view of the prior art showing the second cut that illustrates the third step of the method.

FIG. 5 is a plan view of the prior art showing the second cut that illustrates the third step of the method. In the third step of the method of the present invention, the factory Y-pipe 17 is cut about three inches above the outlet end of the Y-pipe 17. This cut is shown as dotted line B-B in FIG. 5.

Figure 6:
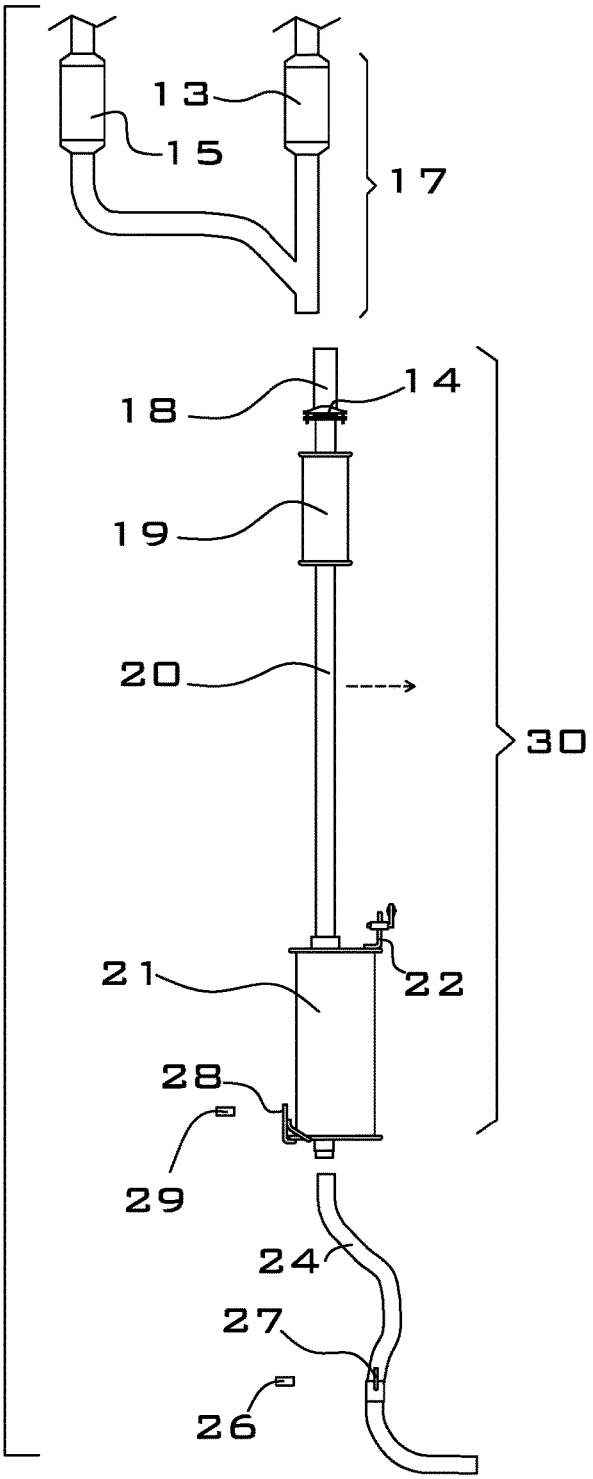
FIGURE 6 PRIOR ART
FIG. 6 is a plan view of the prior art showing the removal of the muffler assembly that illustrates fourth step of the method.

FIG. 6 is a plan view of the prior art showing the removal of the muffler assembly that illustrates fourth step of the method. In the fourth step of the method of the present invention, the fifth hanger 22 is unbolted from the vehicle chassis (not shown) and left attached to the factory muffler 21. The support rod 28 of the sixth hanger 23 is slid out of the isolator 29 of the sixth hanger 23, and the factory muffler assembly 30 is removed, leaving the isolator 29 attached to the vehicle chassis.

Figure 7:
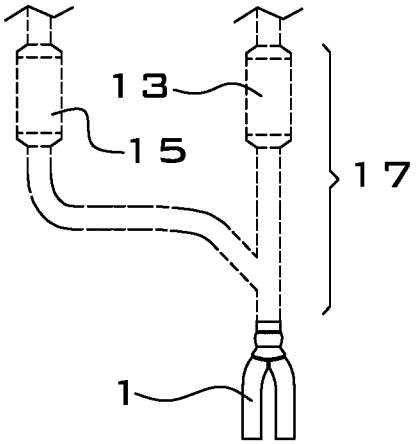
FIG. 7 is a plan view showing the exhaust pulse balance chamber connected to the prior art Y-pipe that illustrates the fifth step of the method.
Figure 23:
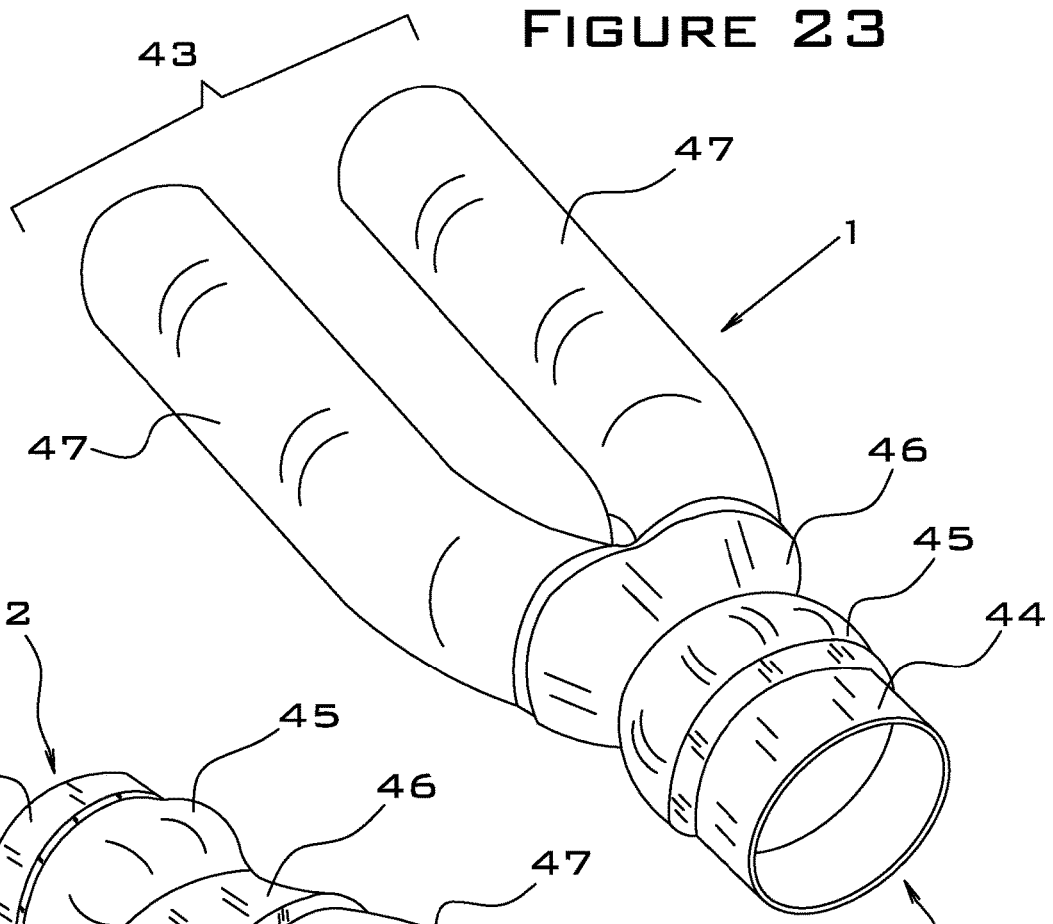
FIG. 23 is a first perspective view of the exhaust pulse balance chamber showing the inlet end.
Figure 24:
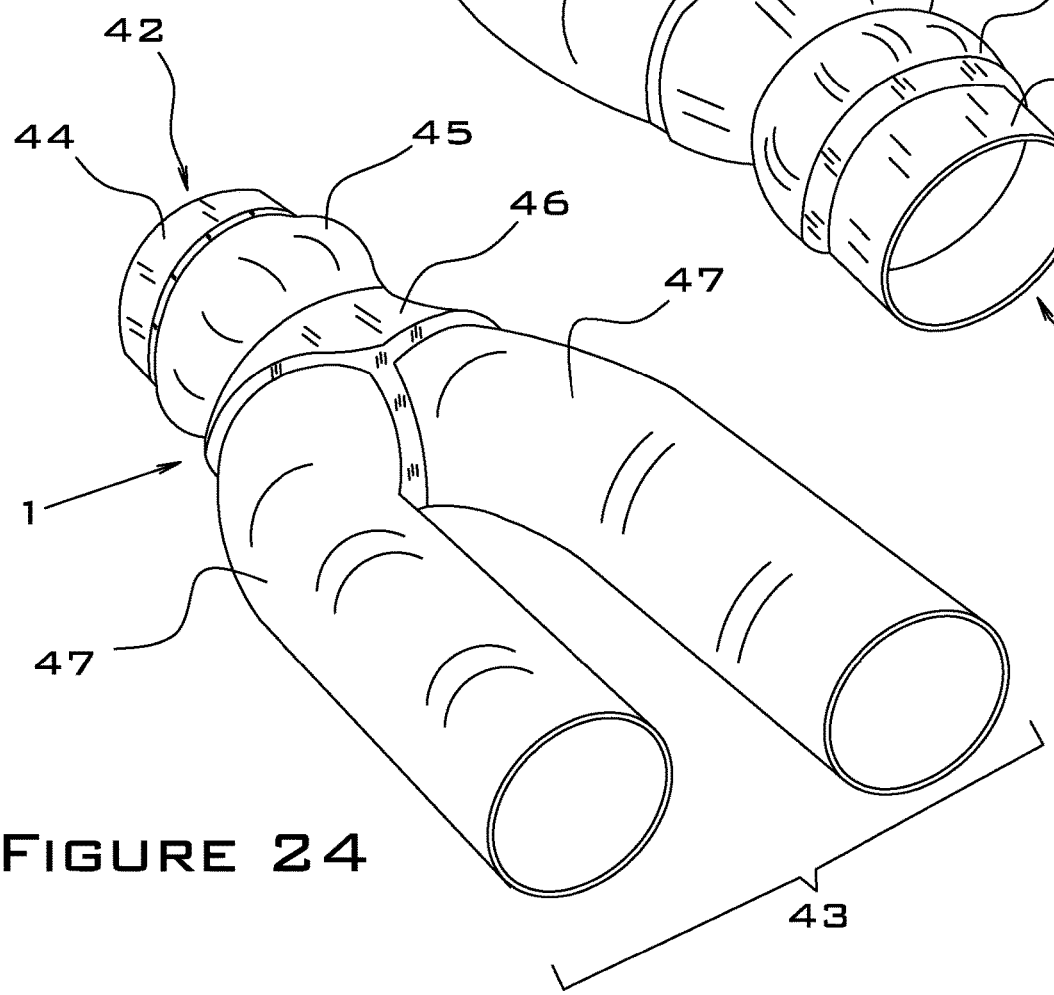
FIG. 24 is a second perspective view of the exhaust pulse balance chamber showing the outlet ends.

FIG. 7 is a plan view showing the exhaust pulse balance chamber connected to the prior art Y-pipe that illustrates the fifth step of the method. From FIG. 7 on, the prior art parts are shown in broken lines. In the fifth step of the method of the present invention, the inlet end of the exhaust pulse balance chamber 1 is installed over (or onto) the cutoff outlet end of the factory Y-pipe 17. The exhaust pulse balance chamber 1 is rotated so that the two legs 47 (shown in FIG. 23) of the exhaust pulse balance chamber 1 are parallel with the vehicle chassis. The exhaust pulse balance chamber is then spot welded in place.

Figure 8:
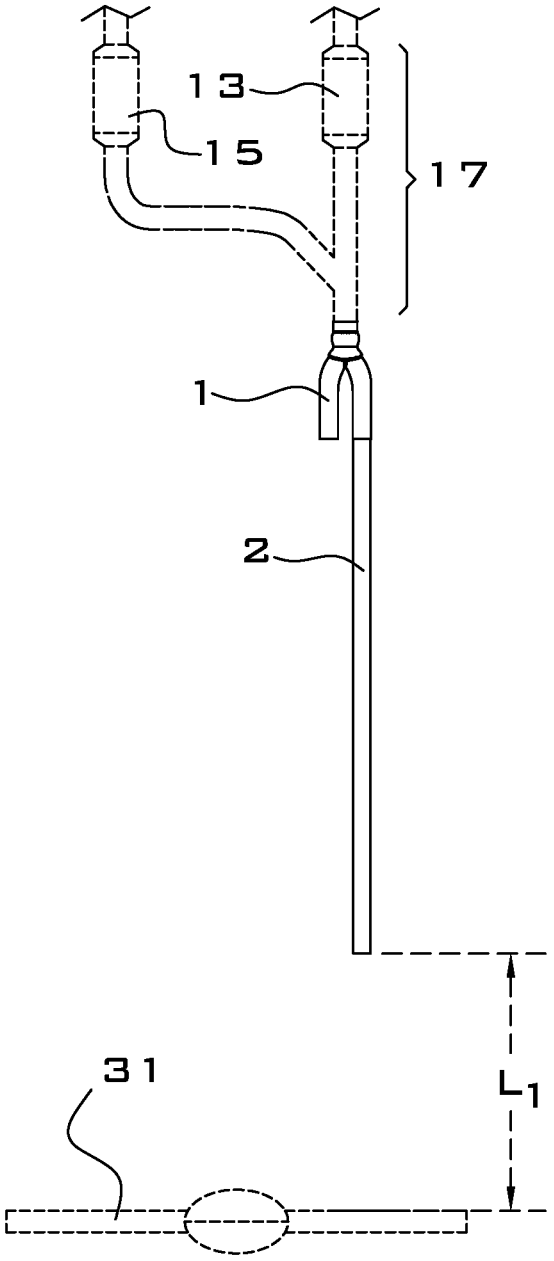
FIG. 8 is a plan view showing the right intermediate pipe connected to the exhaust pulse balance chamber that illustrates the sixth step of the method.

FIG. 8 is a plan view showing the right intermediate pipe connected to the exhaust pulse balance chamber that illustrates the sixth step of the method. In the sixth step of the method of the present invention, the inlet end of the right intermediate pipe 2 is installed into (or onto) the right outlet end of the exhaust balance pulse chamber 1. The distance ($L_1$) from the outlet end of the right intermediate pipe to the front edge of the housing of the rear axle assembly 31 of the vehicle is adjusted to be 33.5 inches. The seam of the right intermediate pipe 2 is adjusted so as to be straight up on the top side of the pipe. The right intermediate pipe 2 is then spot welded in place.

Figure 9:
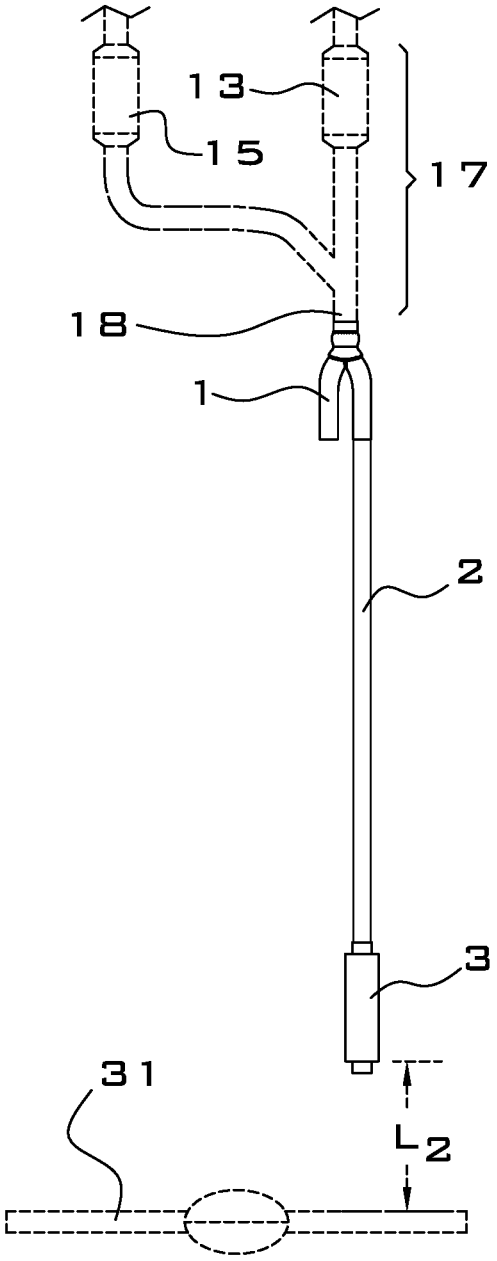
FIG. 9 is a plan view showing the right muffler connected to the right intermediate pipe that illustrates the seventh step of the method.

FIG. 9 is a plan view showing the right muffler connected to the right intermediate pipe that illustrates the seventh step of the method. In the seventh step of the method of the present invention, the inlet end of the right replacement muffler 3 is slipped over the outlet end of the right intermediate pipe 2. The distance ($L_2$) from the outlet end of the right replacement muffler 3 to the front edge of the housing o the rear axle assembly 31 is adjusted to be 19.5 inches. The right replacement muffler 3 is then spot welded in place.

Figure 10:
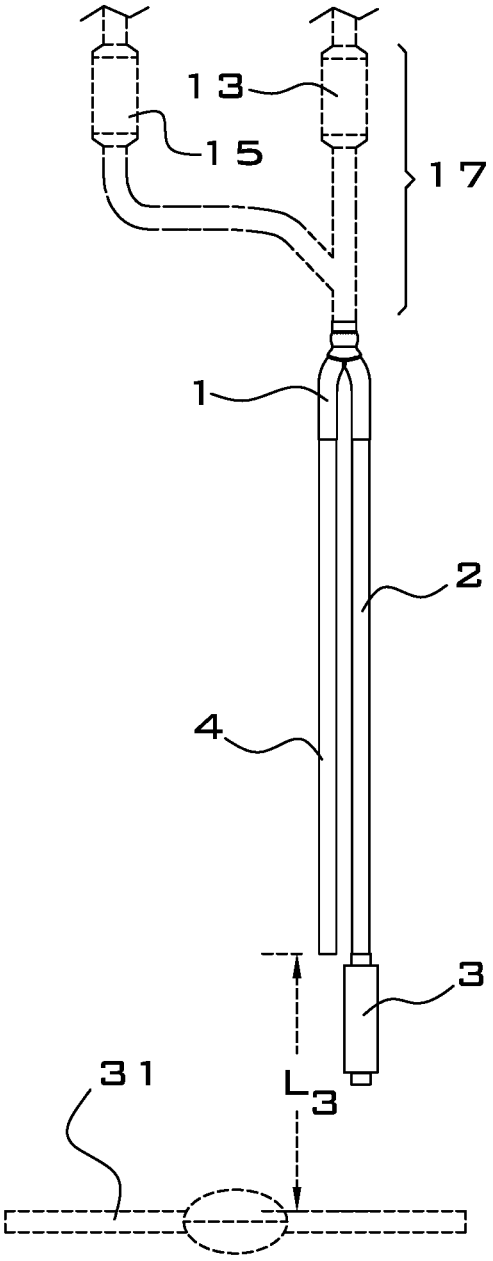
FIG. 10 is a plan view showing the left intermediate pipe connected to the exhaust pulse balance chamber that illustrates the eighth step of the method.

FIG. 10 is a plan view showing the left intermediate pipe connected to the exhaust pulse balance chamber that illustrates the eighth step of the method. In the eighth step of the method of the present invention, the inlet end of the left intermediate pipe 4 is installed into (or onto) the left outlet end of the exhaust balance pulse chamber 1. The distance ($L_3$) from the outlet end of the left intermediate pipe to the front edge of the housing of the rear axle assembly 31 of the vehicle is adjusted to be 33.5 inches. The seam of the left intermediate pipe 4 is adjusted so as to be straight up on the top side of the pipe. The left intermediate pipe 4 is then spot welded in place.

Figure 11:
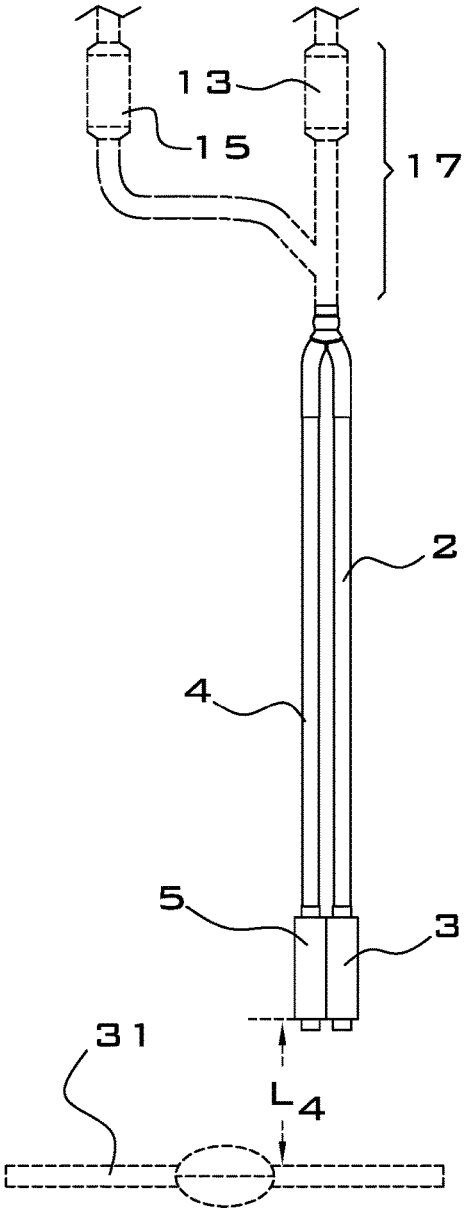
FIG. 11 is a plan view showing the left muffler connected to the left intermediate pipe that illustrates the ninth step of the method.

FIG. 11 is a plan view showing the left muffler connected to the left intermediate pipe that illustrates the ninth step of the method. In the ninth step of the method of the present invention, the inlet end of the left replacement muffler 5 is slipped over the outlet end of the left intermediate pipe 4. The distance ($L_4$) from the outlet end of the left replacement muffler 5 to the front edge of the housing of the rear axle assembly 31 is adjusted to be 19.5 inches. The left replacement muffler 5 is then spot welded in place, and the right and left replacement mufflers 3, 5 are spot welded together to eliminate rattling noise.

Figure 12:
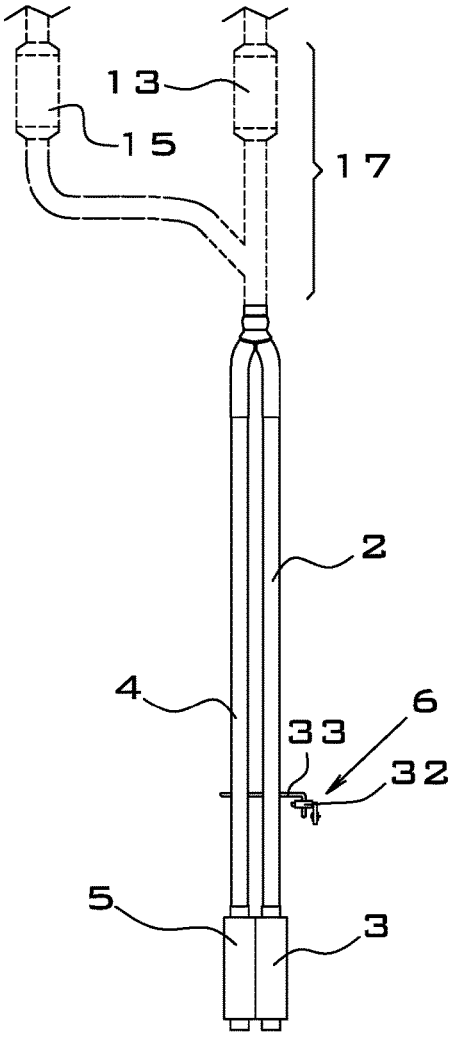
FIG. 12 is a plan view showing the first hanger connected to the left and right intermediate pipes that illustrates the tenth step of the method.

FIG. 12 is a plan view showing the first hanger connected to the left and right intermediate pipes that illustrates the tenth step of the method. In the tenth step in the method of the present invention, the first hanger 6 is installed by bolting the isolator 32 to the vehicle chassis and welding the support rod 33 to the bottom edges of the left and right intermediate pipes 2, 4 (shown in detail in FIG. 19).

Figure 13:
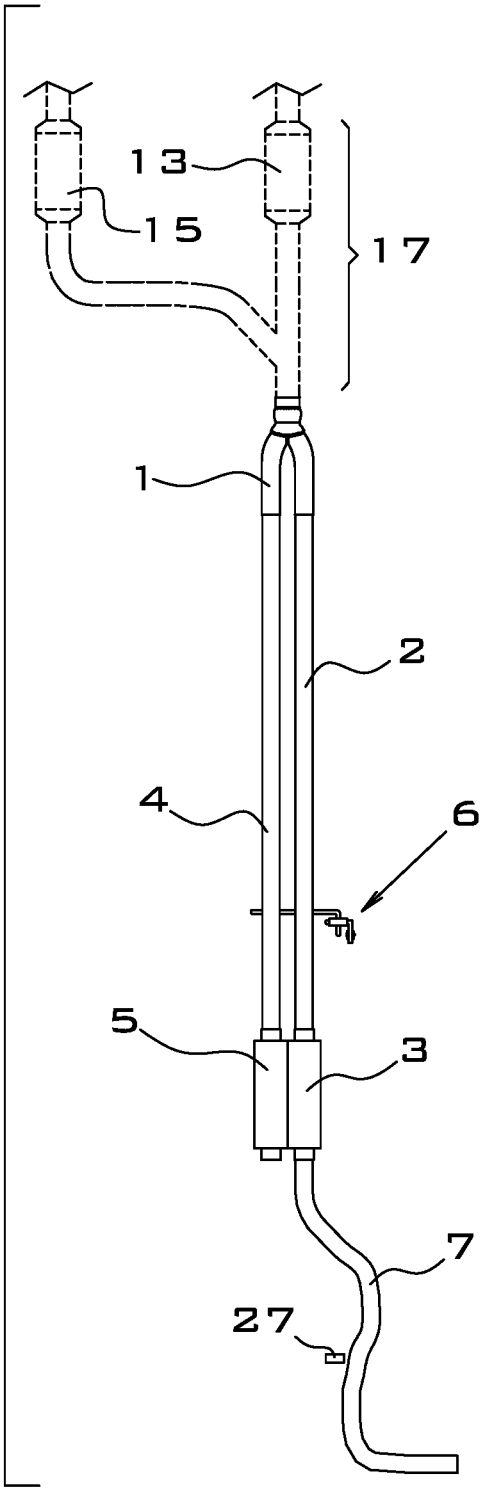
FIG. 13 is a plan view showing the right tailpipe connected to the right muffler that illustrates the eleventh step of the method.

FIG. 13 is a plan view showing the right tailpipe connected to the right muffler that illustrates the eleventh step of the method. In the eleventh step in the method of the present invention, the right tailpipe 7 is installed by inserting the inlet end of the right tailpipe 7 into the outlet end of the right replacement muffler 3. The right tailpipe is then spot welded in place.

Figure 14:
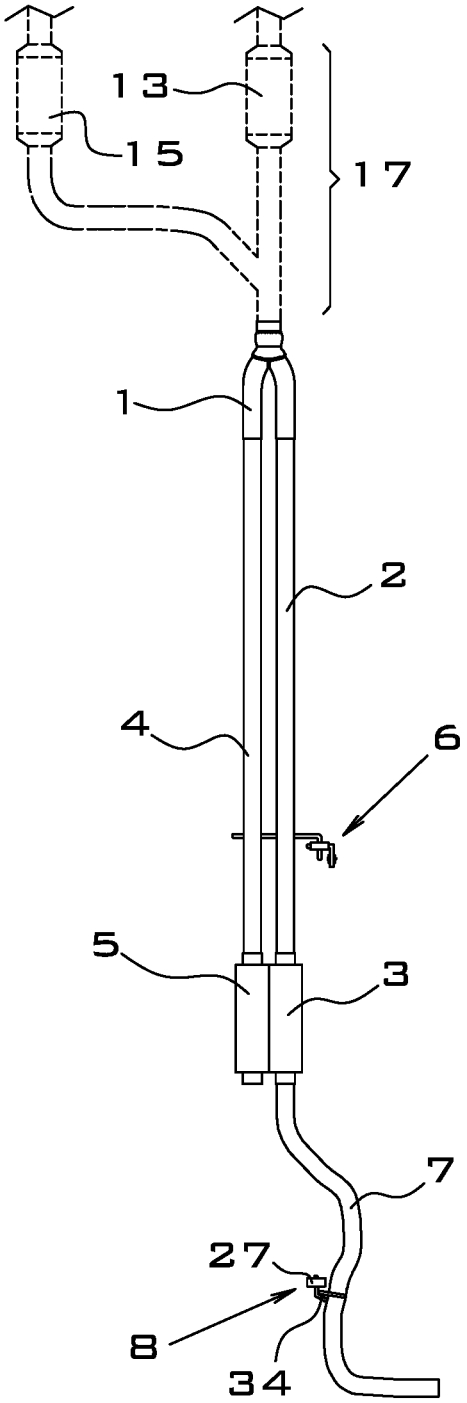
FIG. 14 is a plan view showing the second hanger connected to the right tailpipe that illustrates the twelfth step of the method.

FIG. 14 is a plan view showing the second hanger connected to the right tailpipe that illustrates the twelfth step of the method. In the twelfth step of the method of the present invention, the second hanger 8 is installed onto the right tailpipe 7 by welding a pair of support rods 34 to the right tailpipe 7 and welding the ends of the rods together. One end of the longer of the two support rods 34 is inserted into the isolator 27 of the seventh hanger, which was left mounted to the vehicle chassis (shown in detail in FIG. 20).

Figure 15:
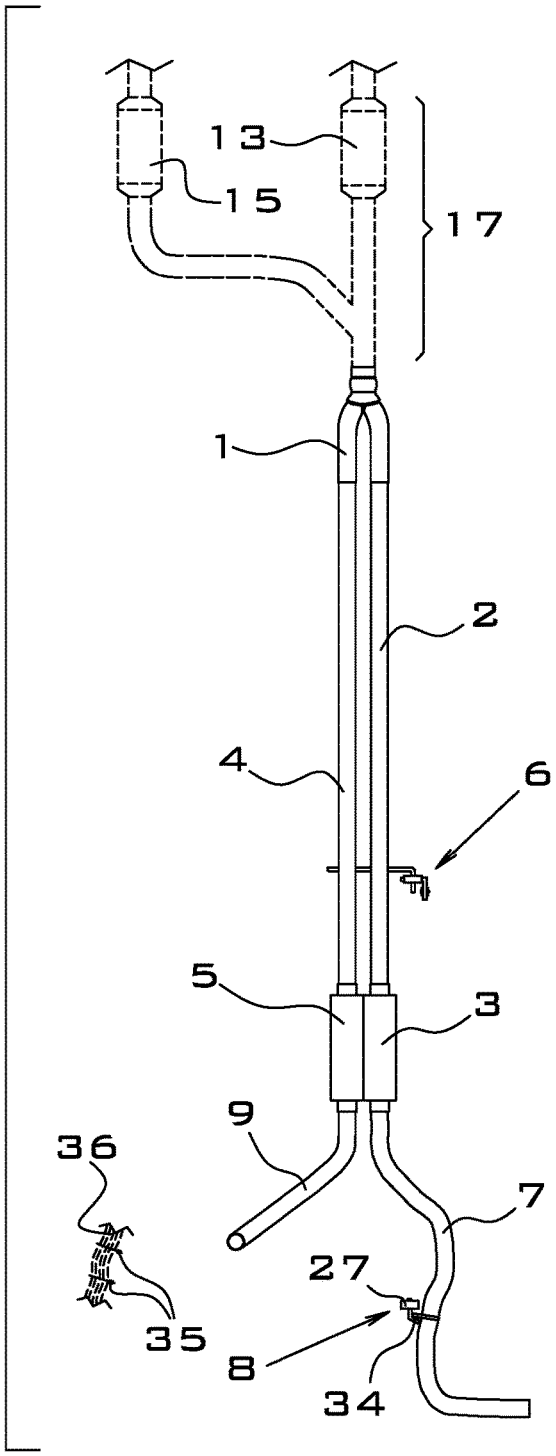
FIG. 15 is a plan view showing the axle pipe connected to the left muffler and the wire bundle of the prior art tied back with zip ties that illustrates the thirteenth step of the method.

FIG. 15 is a plan view showing the axle pipe connected to the left muffler and the wire bundle of the prior art tied back with zip ties that illustrates the thirteenth step of the method. In the thirteenth step of the method of the present invention, two zip ties 35 are used to encircle the wire bundle 36, which is pulled away from the area where the axle pipe 9 will be installed. (The wire bundle 36 includes the brake line, the ABS wiring cable, the rear end vent line, and the speed sensor cable.) The axle pipe 9 is installed by slipping the inlet end of the axle pipe 9 into (or onto) the outlet end of the left replacement muffler 5.

Figure 16:
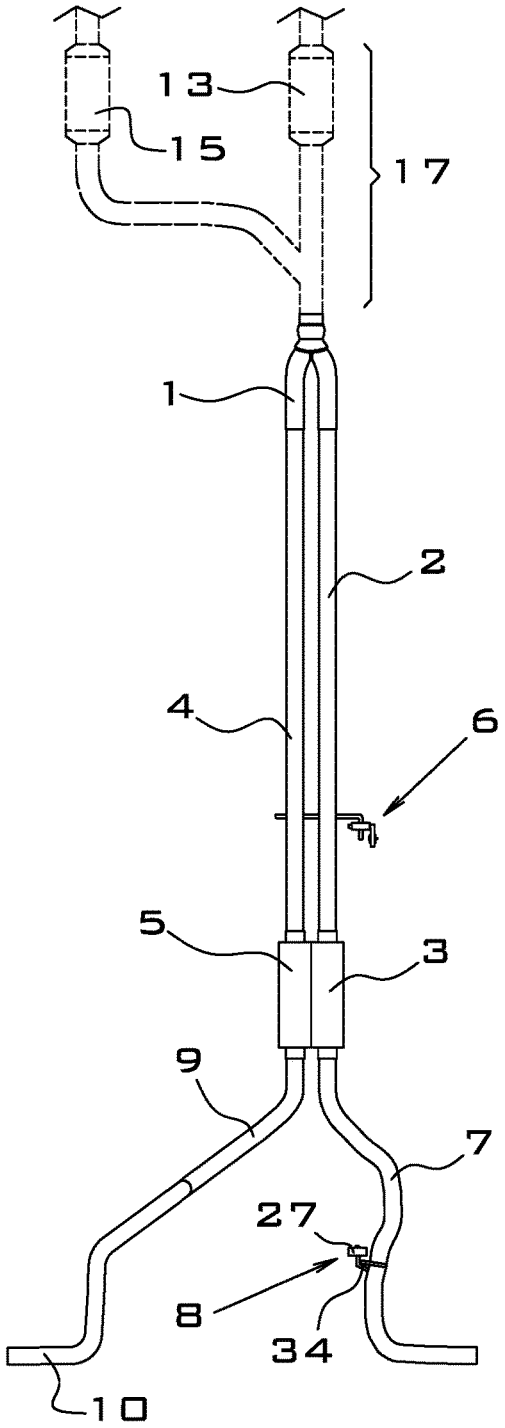
FIG. 16 is a plan view showing the left tailpipe connected to the axle pipe showing the fourteenth step of the method.

FIG. 16 is a plan view showing the left tailpipe connected to the axle pipe showing the fourteenth step of the method. In the fourteenth step of the method of the present invention, the left tailpipe 10 is installed by inserting the inlet end of the left tailpipe 10 into (or onto) the outlet end of the axle pipe 9. The length and angle of the left tailpipe 10 are adjusted to the desired position. The axle pipe 9 is spot welded to the left replacement muffler 5, and the left tailpipe 10 is spot welded to the axle pipe 9.

Figure 17:
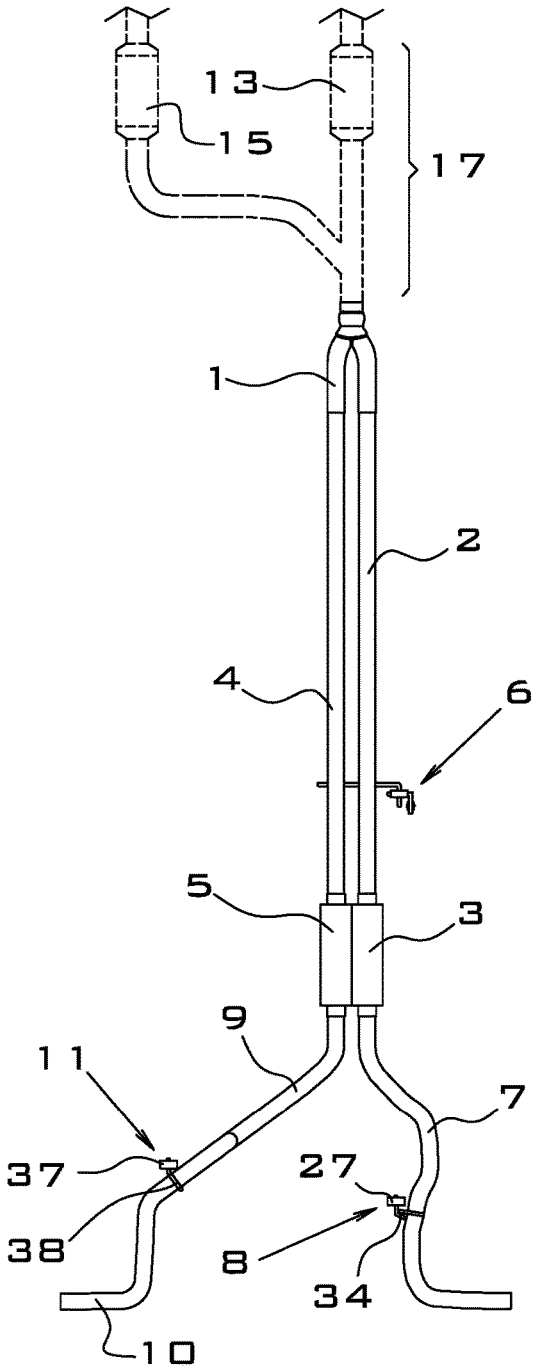
FIG. 17 is a plan view showing the third hanger connected to the left tailpipe that illustrates the fifteenth step of the method.

FIG. 17 is a plan view showing the third hanger connected to the left tailpipe that illustrates the fifteenth step of the method. In the fifteenth step of the method of the present invention, the third hanger 11 is installed by attaching the isolator 37 of the third hanger 11 to the vehicle chassis (using existing holes, if provided). A pair of support rods 38 is welded to the left tailpipe 10, and the ends of the support rods 38 are welded together. One end of the longer of the two support rods 38 is inserted into the isolator 37. A used isolator that was removed from one of the prior art hangers may optionally be used for this hanger (shown in detail in FIG. 21).

Figure 18:
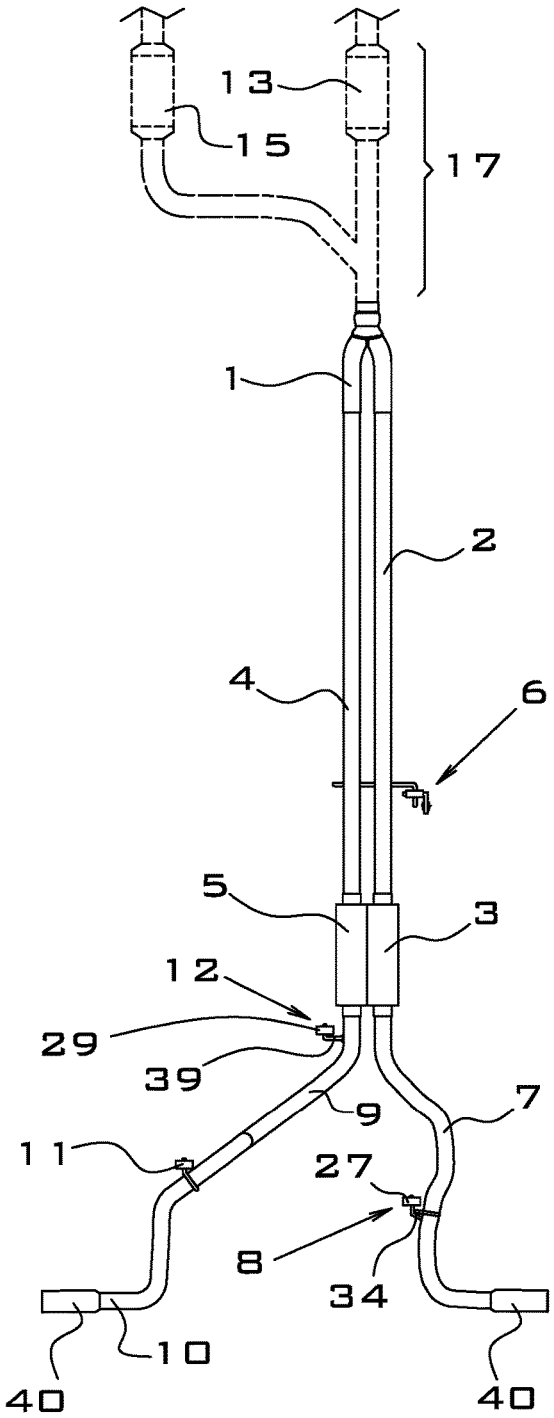
FIG. 18 is a plan view showing the fourth hanger connected to the left tailpipe and optional decorative tips attached to the ends of the right and left tailpipes that illustrates the sixteenth step of the method.

FIG. 18 is a plan view showing the fourth hanger connected to the left tailpipe and optional decorative tips attached to the ends of the right and left tailpipes that illustrates the sixteenth step of the method. In the sixteenth step of the method of the present invention, the fourth hanger is installed by welding a support rod 39 to the inlet end of the axle pipe 9 and inserting and end of the support rod 39 into the isolator 29 of the sixth hanger, which was left mounted to the vehicle chassis (shown in detail in FIG. 22). Optional decorative exhaust tips 40 may be welded to the outlet ends of the right tailpipe 7 and left tailpipe 10 if desired. Continuous gas-tight welds are made around all pipe connections that were previously spot welded.

Figure 19:
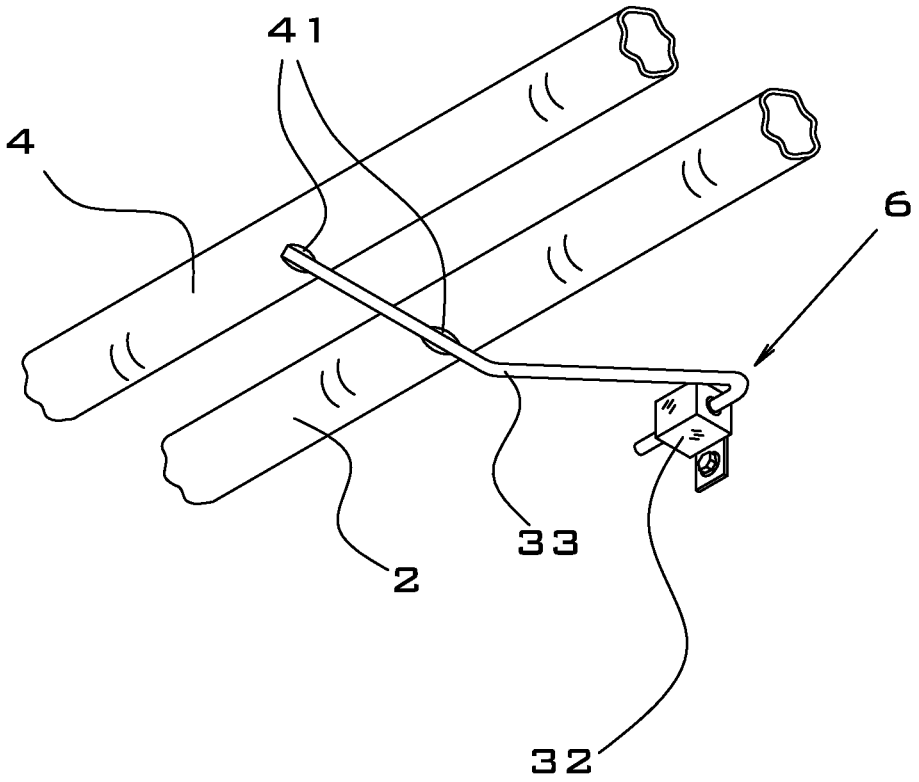
FIG. 19 is a perspective view of the first hanger showing the attachment of the hanger to the underside of the right and left intermediate pipes.

FIG. 19 is a perspective view of the first hanger showing the attachment of the hanger to the underside of the right and left intermediate pipes. As shown in this figure, the first hanger 6 is comprised of an isolator 32 and a support rod 33. The support rods 33 of the first hanger is spot welded 41 to the underside of the right and left intermediate pipes 2, 4, as explained above.

Figure 20:
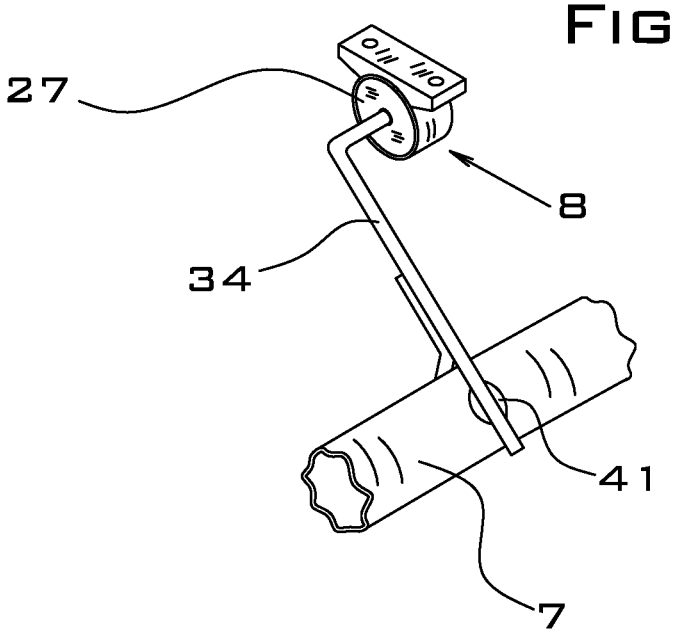
FIG. 20 is a perspective view of the second hanger showing the attachment of the hanger to the sides of the right tailpipe.

FIG. 20 is a perspective view of the second hanger showing the attachment of the hanger to the sides of the right tailpipe. As shown in this figure, the second hanger 8 is comprised of an isolator 27 and two support rods 34 that are welded 41 together and welded 41 to the right tailpipe 7, as explained above.

FIG. 21 is a perspective view of the third hanger showing the attachment of the hanger to the sides of the left tailpipe. As shown in this figure, the third hanger 11 is comprised of an isolator 37 and two supports rods 38 that are welded together and spot welded 41 to the left tailpipe 10, as explained above.

FIG. 22 is a perspective view of the fourth hanger showing the attachment of the hanger to the left side of the axle pipe. As shown in this figure, the fourth hanger 12 is comprised of an isolator 29 and a support rod 39, which is spot welded 41 to the axle pipe 9 as it exits the muffler 5, as explained above.

FIGS. 23-26 are detail views of the exhaust pulse balance chamber of the present invention. As shown in these figures, the exhaust pulse balance chamber 1 comprises a proximal end 42 and a distal end 43. The exhaust pulse balance chamber 1 comprises a circular collar 44 at the proximal end 42 (or inlet) of the exhaust pulse balance chamber 1. The exhaust pulse balance chamber 1 further comprises a mid-section 45, a skirt 46, and right and left legs 47. The circular collar 44 is configured to connect to the outlet end of the factory Y-pipe 17. The circular collar 44 has a constant inner diameter that is smaller than the inner diameter of the mid-section 45 at the central lateral axis of the mid-section (explained more fully in the succeeding paragraph). The mid-section 45 is configured to form a bulge, much like a belly, between the circular collar 44 and the skirt 46.

Specifically, the mid-section 45 bulges at its center and tapers at its proximal end to approximately the same outer diameter as the circular collar 44 and at its distal end to the same outer diameter as the proximal end of the skirt 46. In a preferred embodiment, the mid-section 45 and the skirt 46 are formed from a single piece of steel that is welded to the circular collar 44 and the legs 47 (see also FIG. 26). The mid-section 45 does not have a constant outer diameter but rather an outer diameter that increases from the proximal end of the mid-section 45 to a central lateral (right-to-left on FIG. 25) axis of the mid-section 45, where the outer diameter of the mid-section 45 is the greatest, and then decreases from the central lateral axis of the mid-section 45 to the distal end of the mid-section 45, where the outer diameter of the mid-section equals the inner diameter of the mid-section at the proximal end of the mid-section. The inner diameter of the mid-section similarly increases and decreases along with the outer diameter; the only difference between the inner and outer diameter of the mid-section (or of any other part of the exhaust pulse balance chamber) is the thickness of the pipe. This bulge in the exhaust pulse balance chamber is critical to the efficacy of the present invention and distinguishes it from other "X" pipe designs.

Figures 25, 26:
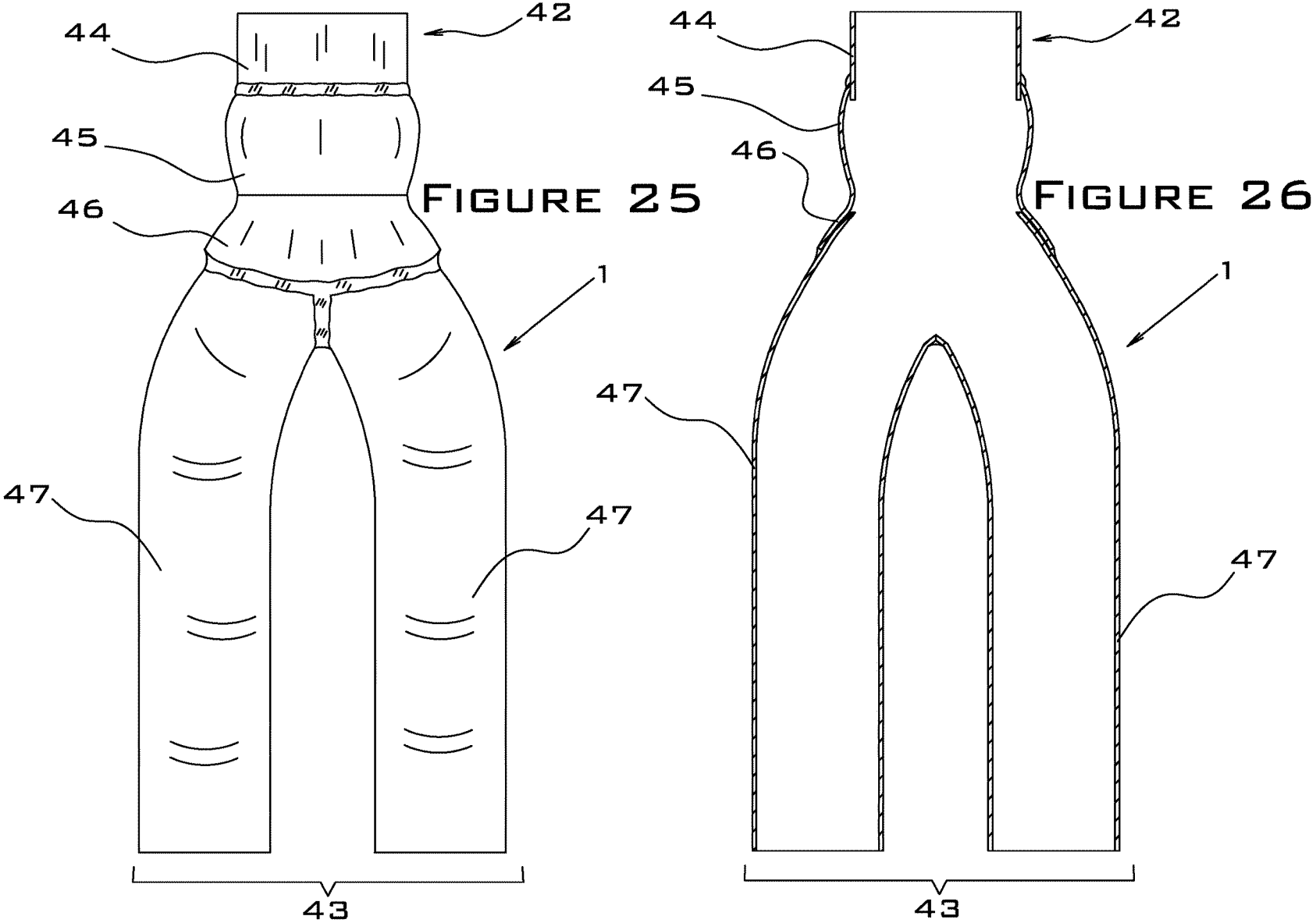
FIG. 25 is a plan view of the exhaust pulse balance chamber.
FIG. 26 is a cross-section view of the exhaust pulse balance chamber.
Figure 28:
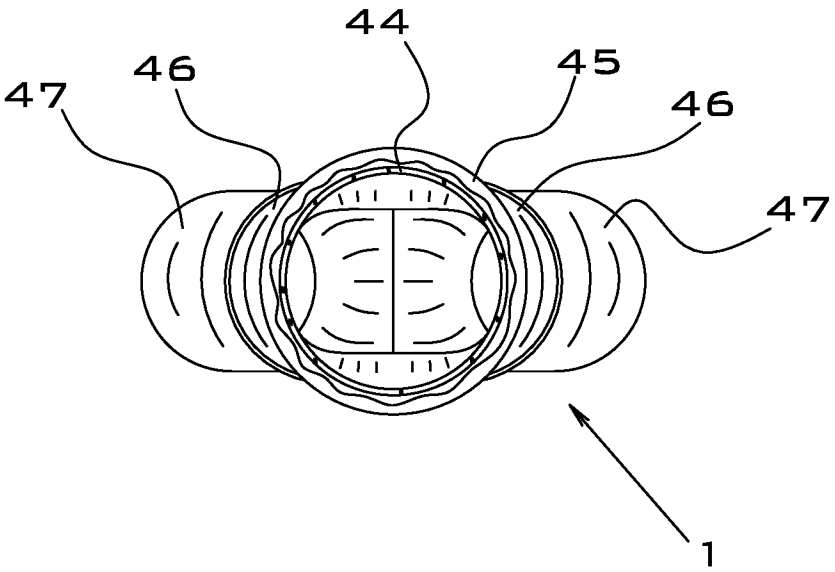
FIG. 28 is a top view of the present invention.
Figure 27:
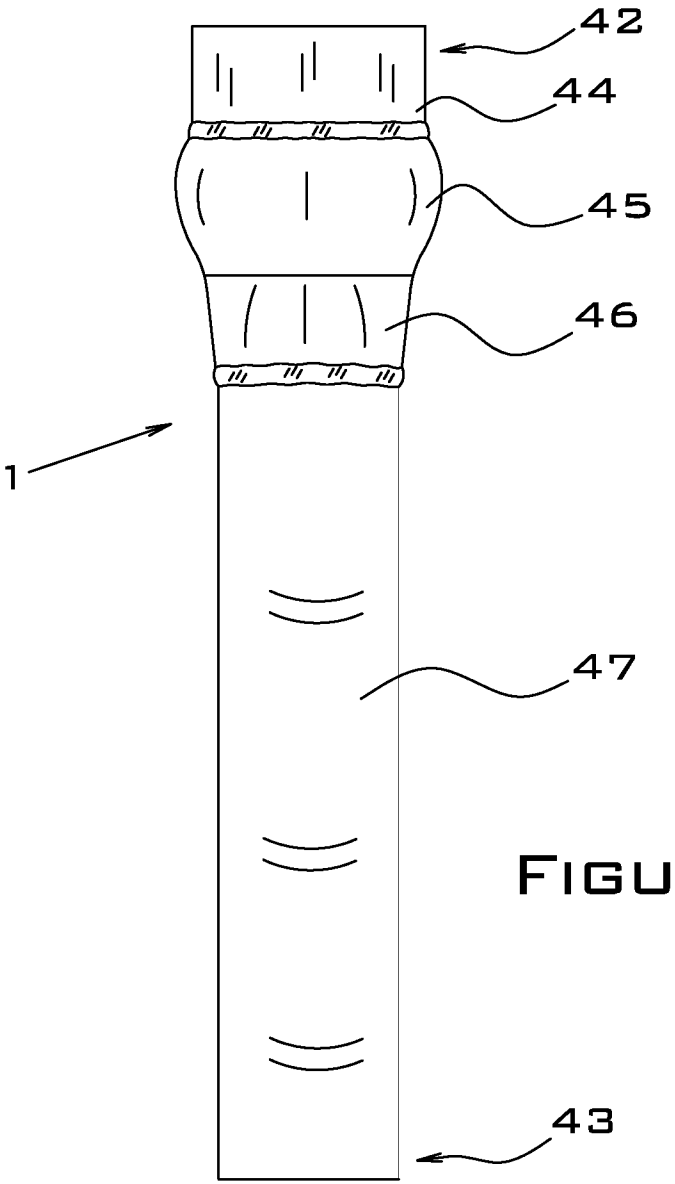
FIG. 27 is a side view of the present invention.

The distal end of the mid-section 45 is attached to the proximal end of the skirt 46. (As noted above, the mid-section 45 and skirt 46 may be formed of the same piece of steel.) The outer diameter of the skirt 46 increases in a left-to-right direction only (in relation to FIG. 25) from the proximal end of the skirt to the distal end of the skirt, which is configured to receive or connect to the right and left legs 47 of the exhaust pulse balance chamber 1. Note that the skirt 46 extends over and around the proximal ends of the legs 47, as shown in FIG. 26. The outer diameter of the skirt 46 remains relatively constant from front to back, and the depth (outer diameter measured front to back) of the skirt is less than the outer diameter of the circular collar 44. The width (outer diameter measured right to left) of the skirt 46 at its distal end is approximately twice that of the depth of the skirt at its distal end.

The proximal end of each of the left and right legs 47 is joined or connected to the distal end of the skirt 46. As shown in FIG. 26, the proximal end of each leg 47 extends from the distal end of the skirt 46 at a 30-degree angle for approximately ⅓ of the total length of the leg. The remaining approximately ⅔ of the legs are parallel to the central longitudinal axis of the exhaust pulse balance chamber 1 and to each other. The legs 47 are approximately three times the length of the circular collar 44, mid-section 45 and skirt 46 combined (measuring along the entire length of the legs, including the bend).

The entire exhaust pulse balance chamber 1 is sealed to the exterior environment except at the proximal end of the circular collar 44 and the distal ends of the legs 47, both of which are open. All parts of the exhaust pulse balance chamber are hollow (they are not solid, and there are no bars, baffles or other parts inside of the exhaust pulse balance chamber), and they are all in fluid communication with each other. Exhaust gases from the factory Y-pipe will flow from the circular collar 44 into the mid-section 45, where the exhaust gases mix, and then into the skirt 46 and the right and left legs 47. All parts of the exhaust chamber are preferably comprised of 14-gauge steel pipe and welded together.

In a preferred embodiment, the circular collar 44 has an inner diameter of three inches, and the mid-section 45 has an outer diameter of four inches at the central lateral axis of the mid-section. Each of the two legs 47 preferably has an outer diameter of two and ½ inches. In a preferred embodiment, the distance from the proximal end of the circular collar 44 to the distal end of the skirt 46 is five inches, and the distance from the proximal end of the skirt 46 to the distal end of the legs 47 is twelve inches. The outer diameter of the proximal end of the skirt 46 measured front to back is preferably three inches. The outer diameter of the proximal end of the skirt 46 measured right to left is preferably five inches. There is a space of two inches between the right and left legs 47 along that part of the legs in which they are parallel to each other.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. An exhaust pulse balance chamber comprising:

(a) a proximal end and a distal end;

(b) a circular collar at the proximal end of the exhaust pulse balance chamber;

(c) a mid-section;

(d) one and only one skirt; and (e) a right leg and a left leg;

wherein the circular collar is configured to connect to an outlet end of a factory Y-pipe;

wherein the mid-section has an inner diameter;

wherein the circular collar has a constant inner diameter that is smaller than the inner diameter of the mid-section at a central lateral axis of the mid-section;

wherein the mid-section is configured to form a bulge between the circular collar and the skirt;

wherein the mid-section has an outer diameter;

wherein the outer diameter of the mid-section increases from the proximal end of the mid-section to the central lateral axis of the mid-section and decreases from the central lateral axis of the mid-section to the distal end of the mid-section;

wherein the distal end of the mid-section is joined to a proximal end of the skirt;

wherein the skirt has an outer diameter;

wherein the circular collar has an outer diameter, and the proximal end of the mid-section has an outer diameter that is approximately equal to the outer diameter of the circular collar;

wherein the distal end of the mid-section has an outer diameter that is approximately equal to the outer diameter of the skirt at the proximal end of the skirt;

wherein the inner diameter of the circular collar is approximately equal to the outer diameter of the skirt measured front-to-back at the proximal end of the skirt;

wherein the outer diameter of the skirt increases in a left-to-right direction without increasing in a front-to-back direction from the proximal end of the skirt to a distal end of the skirt;

wherein the distal end of the skirt is configured to receive the right and left legs;

wherein each of the right and left legs has a proximal end;

wherein the proximal end of each of the right and left legs extends from the distal end of the skirt at a first 30-degree angle relative to a central longitudinal axis of the exhaust pulse balance chamber for a first distance;

wherein each of the right and left legs bends at a second 30-degree angle after the first distance and then extends for a second distance;

wherein the right and left legs are parallel to each other for the second distance;

wherein the exhaust pulse balance chamber is sealed to an exterior environment except at the proximal end of the circular collar and the distal ends of the right and left legs; and wherein the circular collar, mid-section, skirt and right and left legs are all within fluid communications with one another.

2. The exhaust pulse balance chamber of claim 1, wherein the mid-section and the skirt are formed form a single piece of metal that is welded to the circular collar and to the right and left legs.

3. The exhaust pulse balance chamber of claim 1, wherein the outer diameter of the mid-section at the distal end of the mid-section equals the inner diameter of the mid-section at the proximal end of the mid-section.

4. The exhaust pulse balance chamber of claim 1, wherein the skirt extends over and around the proximal ends of the right and left legs.

5. The exhaust pulse balance chamber of claim 1, wherein the circular collar has an outer diameter that is constant; and wherein the outer diameter of the skirt measured front-to-back is less than the outer diameter of the circular collar.

6. The exhaust pulse balance chamber of claim 1, wherein the outer diameter of the skirt measured right-to-left at a distal end of the skirt is approximately two times the outer diameter of the skirt measured front-to-back at a distal end of the skirt.

7. The exhaust pulse balance chamber of claim 1, wherein the first distance is approximately equal to one-third of the second distance.

8. The exhaust pulse balance chamber of claim 1, wherein each of the right and left legs has a length; and wherein the length of each of the right and left legs is approximately three times a length of the circular collar, the mid-section and the skirt combined.

9. A method of converting a vehicle from a dual-in, single-out exhaust system to a dual-in, dual-out exhaust system, the vehicle comprising a factory muffler assembly and a chassis, the method comprising the steps of:

(a) cutting a factory tailpipe behind an outlet end of a factory muffler;
(b) removing the factory tailpipe;
(c) cutting a factory Y-pipe above an outlet end of the factory Y-pipe;
(d) removing the factory muffler assembly from the vehicle;
(e) installing the exhaust pulse balance chamber of claim 1 onto the cutoff outlet end of the factory Y-pipe;
(f) rotating the exhaust pulse balance chamber so that the right and left legs of the exhaust pulse balance chamber are parallel with the vehicle chassis;
(g) connecting an inlet end of a right intermediate pipe to the distal end of the right leg of the exhaust pulse balance chamber;
(h) installing an inlet end of a right replacement muffler onto an outlet end of the right intermediate pipe;
(i) connecting an inlet end of a left intermediate pipe to the distal end of the left leg of the exhaust pulse balance chamber;
(j) installing an inlet end of a left replacement muffler onto an outlet end of the left intermediate pipe;
(k) welding together the right and left replacement mufflers;
(l) installing an inlet end of a right tailpipe onto an outlet end of the right replacement muffler;
(m) installing an inlet end of an axle pipe onto an outlet end of the left replacement muffler;
(n) installing an inlet end of a left tailpipe onto an outlet end of the axle pipe; and
(o) laying down continuous gas-tight welds around all pipe connections.

10. A kit for converting a vehicle from a dual-in, single-out exhaust system to a dual-in, dual-out exhaust system, the kit comprising:
(a) the exhaust pulse balance chamber of claim 1;
(b) a right intermediate pipe;
(c) a right replacement muffler;
(d) a left intermediate pipe;
(e) a left replacement muffler;
(f) a right tailpipe;
(g) an axle pipe; and
(h) a left tailpipe.

* * * * *